US010391663B2

(12) United States Patent
Tsuji et al.

(10) Patent No.: US 10,391,663 B2
(45) Date of Patent: Aug. 27, 2019

(54) ROLL FOR ROTARY CUTTER AND ROTARY CUTTER

(71) Applicant: NIPPON TUNGSTEN CO., LTD., Fukuoka (JP)

(72) Inventors: Yasunori Tsuji, Fukuoka (JP); Yohei Nakashima, Fukuoka (JP); Kenji Nakahara, Fukuoka (JP)

(73) Assignee: NIPPON TUNGSTEN CO., LTD., Fukuoka-shi (JP)

( * ) Notice: Subject to any disclaimer, the term of this patent is extended or adjusted under 35 U.S.C. 154(b) by 0 days.

(21) Appl. No.: 15/439,016

(22) Filed: Feb. 22, 2017

(65) Prior Publication Data

US 2017/0239832 A1 Aug. 24, 2017

(30) Foreign Application Priority Data

Feb. 24, 2016 (JP) ..... 2016-033432
Jan. 23, 2017 (JP) ..... 2017-009176

(51) Int. Cl.
*B26D 1/62* (2006.01)
*B26D 7/26* (2006.01)
(Continued)

(52) U.S. Cl.
CPC ..... *B26D 7/265* (2013.01); *B26D 1/405* (2013.01); *B26D 7/204* (2013.01); *B26F 1/384* (2013.01);
(Continued)

(58) Field of Classification Search
CPC ..... D21G 1/0206; D21G 1/0213; B65H 2404/1371; B65H 2404/1372; B26D 1/626
(Continued)

(56) References Cited

U.S. PATENT DOCUMENTS 242,058 A * 5/1881 Schurmann ..... B21B 27/02 492/6
2,048,005 A * 7/1936 Horton ..... B41F 13/08 100/162 B
(Continued)

FOREIGN PATENT DOCUMENTS

CN 1972785 5/2007
DE 2823089 A1 * 11/1979 ..... B29C 43/22
(Continued)

OTHER PUBLICATIONS

English-language translation of allowed claims in Japanese App. No. 2017-009176.

*Primary Examiner* — Kenneth E Peterson
(74) *Attorney, Agent, or Firm* — Nixon Peabody LLP; Jeffrey L. Costellia

(57) ABSTRACT

A cutter roll and an anvil roll, with which it is possible to control deformation in the axial direction, and a rotary cutter having the same. A roll 101, 210 for a rotary cutter includes: a barrel portion having a circumferential surface and a pair of end surfaces located respectively at opposite ends of the circumferential surface; a pair of first depressions 113, 213 having a ring shape or a cylindrical shape and located respectively at the pair of end surfaces of the barrel portion, the pair of first depressions each having a depth direction that is parallel to an axis of the barrel portion; a pair of first bearings 152, 252 located respectively in the pair of first depressions and being in contact with outer walls of the first depressions; and a pair of first bearing boxes 156 located on an outside of the pair of first depressions and having support portions 151*b*, 251*b* to be in contact with a support frame or a pressure mechanism, the pair of first bearing boxes supporting the respective bearings.

15 Claims, 15 Drawing Sheets

(51) Int. Cl.
*B26D 1/40* (2006.01)
*B26D 7/20* (2006.01)
*B26F 1/38* (2006.01)

(52) U.S. Cl.
CPC ..... *B26D 1/626* (2013.01); *B26D 2007/206* (2013.01); *B65H 2404/1372* (2013.01)

(58) Field of Classification Search
USPC ..... 492/6, 7
See application file for complete search history.

(56) References Cited

U.S. PATENT DOCUMENTS 2,187,250 A * 1/1940 Sendzimir ..... B21B 13/147 100/162 B
3,097,591 A * 7/1963 Justus ..... B65H 27/00 100/155 R
3,676,909 A * 7/1972 Tuomaala ..... F16C 13/02 492/6
3,678,846 A * 7/1972 Bjorkegren ..... D21G 1/0026 100/155 R
3,745,625 A * 7/1973 Jaegers ..... D21F 1/40 26/103
3,840,958 A * 10/1974 Mahn ..... B29C 33/044 492/6
4,299,162 A * 11/1981 Hartmann ..... D06C 15/08 100/162 B
4,305,191 A * 12/1981 Enomoto ..... B21B 27/05 492/6
4,356,764 A * 11/1982 Haugen ..... G03G 15/2092 100/157
4,372,205 A * 2/1983 Pflaum ..... B41F 13/18 101/153
4,520,723 A * 6/1985 Pav ..... B21B 27/055 100/162 B
4,602,408 A * 7/1986 Noe ..... B21B 27/05 492/2
4,756,219 A * 7/1988 Pohl ..... B26D 1/626 83/344
4,768,434 A * 9/1988 Beery ..... B30B 3/04 100/157
5,001,820 A * 3/1991 Yoshida ..... B21B 27/05 492/2
5,093,974 A * 3/1992 Ginzburg ..... B21B 27/05 29/447
5,435,038 A * 7/1995 Sauers ..... A47L 9/0455 15/179
5,498,148 A * 3/1996 Ouellette ..... A21C 3/02 264/153
5,913,266 A * 6/1999 Nakaya ..... F16C 13/024 101/375
5,979,305 A * 11/1999 Wadzinski ..... D21G 1/022 100/162 B
6,453,713 B1 * 9/2002 Womer ..... B29C 43/46 425/363
7,789,818 B2 * 9/2010 Gruber-Nadlinger ..... B65H 23/025 492/27
7,862,492 B2 * 1/2011 Kerschbaumer ..... B65H 27/00 492/1
8,127,816 B2 * 3/2012 Gnan ..... D21F 11/12 156/473
2001/0005707 A1 * 6/2001 White ..... B21B 37/007 492/7
2002/0020270 A1 2/2002 Aichele
2006/0048616 A1 3/2006 Grenier et al.
2006/0048621 A1 3/2006 Grenier et al.
2006/0065088 A1 3/2006 Grenier et al.
2015/0090089 A1 4/2015 Horii et al.

FOREIGN PATENT DOCUMENTS

DE 102006057907 A1 * 6/2008 ..... D21F 1/40
EP 1512787 A2 * 3/2005 ..... B65H 27/00
JP 2006-015482 1/2006
JP 2006-021318 1/2006
JP 2006-026888 2/2006
JP 2006-055947 3/2006
JP 2006-130650 5/2006
JP 2008-200805 9/2008
JP 2010-274350 12/2010
JP 2013-027642 2/2013
JP 2014-121763 7/2014
JP 2014-233764 12/2014
JP 2015-066665 4/2015
WO WO 2009146698 A1 * 12/2009 ..... D21G 1/0213

* cited by examiner

ROLL FOR ROTARY CUTTER AND ROTARY CUTTER

CROSS-REFERENCE TO RELATED APPLICATION

This application claims priorities to Japanese Patent Application No. 2016-033432, filed on Feb. 24, 2016 and Japanese Patent Application No. 2017-009176, filed on Jan. 23, 2017, the disclosures of which are hereby incorporated by reference in its entirety.

BACKGROUND

The present application relates to a roll for a rotary cutter and a rotary cutter.

A rotary cutter typically includes a cutter roll with a cutting blade or blades arranged so as to define a desired shape, and an anvil roll receiving the cutting blade, wherein a material to be cut, such as a web of cloth, paper, non-woven fabric, resin, metal foil, etc., can be passed through between the two rolls to continuously cut out cut-out pieces each having the desired shape. A rotary cutter is a machining technique having a high productivity because cut-out pieces can be cut out continuously by the rotational motion of the rollers, requiring only a short amount of time to sever each cut-out piece.

A rotary cutter severs a material to be cut by means of a cutting blade on the cutter roll being pressed against the anvil roll. In order to appropriately maintain the interval between the cutter roll and the anvil roll and to cut through the material with a sufficient load thereon, ring-shaped protrusions, called "guide rings", to be in contact with the anvil roll are provided at the opposite ends of the area of the circumferential surface of the cutter roll in which the cutting blade is provided.

Japanese Laid-Open Patent Publication No. 2006-15482 (hereinafter, referred to as "Patent Document No. 1") points out that as a result of contacting the guide ring to receive a load from the cutter roll, the anvil roll may deform in such a manner that the interval between the cutter roll and the anvil roll increases near the center, whereby the cutting may be incomplete near the center of the cutter roll. In order to solve this problem, Patent Document No. 1 discloses a bearing provided on the anvil roll between a portion of the anvil roll that receives the load from the guide ring of the cutter roll and an anvil portion of the anvil roll.

SUMMARY

A pattern of a cutting blade or blades, in conformity with the cut-out piece, is formed on the circumferential surface of the cutter roll. According to a study by the present inventor, the preferred direction of deformation for the cutter roll and the anvil roll may vary depending on the distribution and density of cutting blades on the circumferential surface.

A non-limiting example embodiment of the present application provides a roll for a rotary cutter and a rotary cutter, with which it is possible to control the deformation of the cutter roll and the anvil roll depending on the various cutting blade patterns.

A roll for a rotary cutter of the present disclosure includes: a barrel portion having a circumferential surface and a pair of end surfaces located respectively at opposite ends of the circumferential surface; a pair of first depressions having a ring shape or a cylindrical shape and located respectively at the pair of end surfaces of the barrel portion, the pair of first depressions each having a depth direction that is parallel to an axis of the barrel portion; a pair of first bearings located respectively in the pair of first depressions and being in contact with outer walls of the first depressions; and a pair of first bearing boxes located on an outside of the pair of first depressions and having support portions to be in contact with a support frame or a pressure mechanism, the pair of first bearing boxes supporting the respective bearings.

In a roll for a rotary cutter and a rotary cutter of the present disclosure, it is possible to change the position of the bearing, and it is therefore possible to control the deformation of the cutter roll and the anvil roll.

DETAILED DESCRIPTION OF EMBODIMENTS

Figure 1:
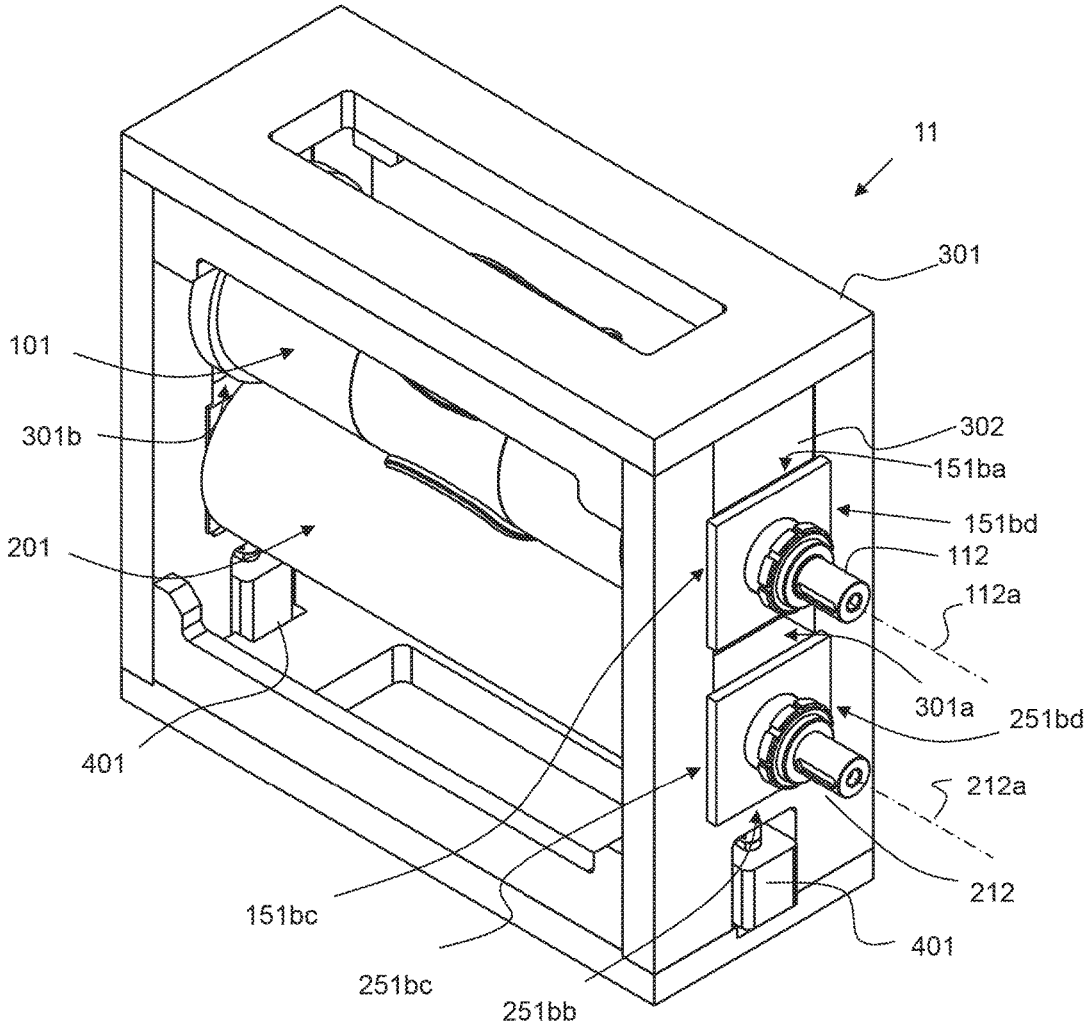
FIG. 1 is a perspective view showing an example rotary cutter of a first embodiment.

The present inventor made an in-depth study on the problems and solutions thereof disclosed in Patent Document No. 1. The deflection (deformation) in the axial direction of the cutter roll and the anvil roll may lead to an insufficient load (pressure) on the cutting blade as disclosed in Patent Document No. 1. Note however that the load on the cutting blade is also correlated with the line density of the cutting blade in the circumferential direction of the cutter roll, and if the cutting blade is continuous in the circumferential direction, for example, good cutting may not be achieved unless a greater load is applied. Therefore, depending on the various cutting blade patterns, the cutter roll and the anvil roll are preferably deformable in directions other than those disclosed in Patent Document No. 1. Also, with the anvil roll disclosed in Patent Document No. 1, the curvature of the deflection of the cutter roll needs to generally coincide with that of the anvil roll. This requires that the diameter ratio between the cutter roll and the anvil roll satisfy a certain optimal range.

In view of these problems, the present inventor conceived a cutter roll and an anvil roll having a novel structure, and a rotary cutter having the same. Below is the summary of a roll for a rotary cutter and a rotary cutter of the present disclosure.

[Item 1] A roll for a rotary cutter comprising:

a barrel portion having a circumferential surface and a pair of end surfaces located respectively at opposite ends of the circumferential surface;

a pair of first depressions having a ring shape or a cylindrical shape and located respectively at the pair of end surfaces of the barrel portion, the pair of first depressions each having a depth direction that is parallel to an axis of the barrel portion;

a pair of first bearings located respectively in the pair of first depressions and being in contact with outer walls of the first depressions; and a pair of first bearing boxes located on an outside of the pair of first depressions and having support portions to be in contact with a support frame or a pressure mechanism, the pair of first bearing boxes supporting the respective bearings.

[Item 2] A roll for a rotary cutter comprising:

a barrel portion having a circumferential surface and a pair of end surfaces located respectively at opposite ends of the circumferential surface;

a pair of shafts connected to the barrel portion and having an axis that coincides with an axis of the circumferential surface;

a pair of first depressions located respectively at the pair of end surfaces of the barrel portion and each having a ring shape extending around the shaft, the pair of first depressions each having a depth direction that is parallel to the axis of the shaft;

a pair of first bearings located respectively in the pair of first depressions and each being in contact with the shaft or outer walls of the first depressions; and a pair of first bearing boxes located on an outside of the pair of first depressions and having support portions to be in contact with a support frame or a pressure mechanism, the pair of first bearing boxes supporting the respective first bearings.

[Item 3] The roll for a rotary cutter according to item 1 or 2, further comprising:

a cutting blade located on the circumferential surface, the cutting blade having a cutting shape; and a pair of guide rings located respectively at opposite ends of the circumferential surface in a longitudinal direction, wherein the roll for a rotary cutter is a cutter roll.

[Item 4] The roll for a rotary cutter according to item 1 or 2, wherein the roll for a rotary cutter is an anvil roll.

[Item 5] A rotary cutter comprising a cutter roll and an anvil roll, the cutter roll comprising:

a barrel portion having a circumferential surface and a pair of end surfaces located respectively at opposite ends of the circumferential surface;

a pair of shafts connected to the barrel portion and having an axis that coincides with an axis of the circumferential surface;

a cutting blade located on the circumferential surface, the cutting blade having a cutting shape; and a pair of guide rings located respectively at opposite ends of the circumferential surface in a longitudinal direction, the anvil roll comprising:

a barrel portion having a circumferential surface that receives the cutting blade and a pair of end surfaces located respectively at opposite ends of the circumferential surface; and a pair of shafts connected to the barrel portion and having an axis that coincides with an axis of the circumferential surface, at least one of the cutter roll and the anvil roll comprising:

a pair of first depressions located respectively at the pair of end surfaces of the barrel portion and each having a ring shape extending around the shaft, the pair of first depressions each having a depth direction that is parallel to the axis of the shaft;

a pair of first bearings located respectively in the pair of first depressions and each being in contact with the shaft or outer walls of the first depressions; and a pair of first bearing boxes located on an outside of the pair of first depressions and having support portions to be in contact with a support frame or a pressure mechanism, the pair of first bearing boxes supporting the respective first bearings.

[Item 6] A rotary cutter comprising a cutter roll and an anvil roll, the cutter roll comprising:

a barrel portion having a circumferential surface and a pair of end surfaces located respectively at opposite ends of the circumferential surface;

a cutting blade located on the circumferential surface, the cutting blade having a cutting shape; and a pair of guide rings located respectively at opposite ends of the circumferential surface in a longitudinal direction, the anvil roll comprising:

a barrel portion having a circumferential surface that receives the cutting blade and a pair of end surfaces located respectively at opposite ends of the circumferential surface, at least one of the cutter roll and the anvil roll comprising:

a pair of shafts connected to the barrel portion and having an axis that coincides with an axis of the circumferential surface, at least one of the cutter roll and the anvil roll comprising:

a pair of first depressions located respectively at the pair of end surfaces of the barrel portion and having a ring shape or a cylindrical shape, the pair of first depressions each having a depth direction that is parallel to an axis of the barrel portion, or a pair of first depressions located respectively at the pair of end surfaces of the barrel portion and each having a ring shape extending around the shaft, the pair of first depressions each having a depth direction that is parallel to the axis of the shaft;

a pair of first bearings located respectively in the pair of first depressions and each being in contact with the shaft or outer walls of the first depressions; and a pair of first bearing boxes located on an outside of the pair of first depressions and having support portions to be in contact with a support frame or a pressure mechanism, the pair of first bearing boxes supporting the respective first bearings.

[Item 7] The rotary cutter according to item 5 or 6, wherein each of the pair of first bearings is arranged at a position that at least partially overlaps with the corresponding guide ring in an axial direction of the circumferential surface.

[Item 8] The rotary cutter according to item 5 or 6, wherein each of the pair of first bearings is arranged more on an inner side of the corresponding end of the circumferential surface than the corresponding guide ring in the axial direction of the circumferential surface.

[Item 9] The rotary cutter according to any one of items 5 to 8, wherein the pair of first depressions, the pair of first bearings and the pair of first bearing boxes are located on the cutter roll.

[Item 10] The rotary cutter according to any one of items 5 to 8, wherein the pair of first depressions, the pair of first bearings and the pair of first bearing boxes are located on the anvil roll.

[Item 11] The rotary cutter according to any one of items 5 to 10, wherein an interval between the pair of first bearings is equal to or less than an interval between the pair of guide rings in an axial direction of the circumferential surface.

[Item 12] The rotary cutter according to any one of items 5 to 11, wherein the pair of first bearings are in an asymmetric arrangement with respect to a center in an axial direction of the circumferential surface.

[Item 13] The rotary cutter according to item 9, the anvil roll comprising:

a pair of second depressions located respectively at a pair of end surfaces of the barrel portion and each having a ring shape extending around the shaft, the pair of second depressions each having a depth direction that is parallel to an axis of the barrel portion;

a pair of second bearings respectively located in the pair of second depressions and each being in contact with the shaft or outer walls of the pair of second depressions; and a pair of second bearing boxes located on an outside of the second depressions and having support portions to be in contact with a support frame or a pressure mechanism, the pair of second bearing boxes supporting the respective bearings.

[Item 14] The rotary cutter according to item 13, wherein an interval between the pair of first bearings is different from an interval between the pair of second bearings.

[Item 15] The rotary cutter according to any one of items 5 to 12, further comprising the support frame, wherein the support frame is in contact with the support portions of the pair of first bearing boxes, supporting at least one of the cutter roll and the anvil roll.

[Item 16] The rotary cutter according to item 14, further comprising the support frame, wherein the support frame is in contact with the support portions of the pair of first bearing boxes and the support portions of the pair of second bearing boxes, supporting the cutter roll and the anvil roll.

[Item 17] The rotary cutter according to item 16, further comprising the pressure mechanism, wherein the pressure mechanism applies a load on the support portions of the pair of first bearing boxes of one of the cutter roll and the anvil roll in such a manner that an axis of the one of the cutter roll and the anvil roll comes closer to an axis of the other one of the cutter roll and the anvil roll.

A cutter roll, an anvil roll and a rotary cutter having the same according to the present disclosure will now be described in detail with reference to the drawings. The following embodiments are illustrative, and the present invention is not limited by these embodiments. In the following description of the embodiments, where reference signs are used in the figures, similar descriptions may be omitted or elements not referred to in the description may not be assigned reference signs for ease of understanding or for avoiding unnecessary redundancy. A rotary cutter roll and an anvil roll will be each referred to generally as a roll for a rotary cutter.

(First Embodiment)

Figure 2A:
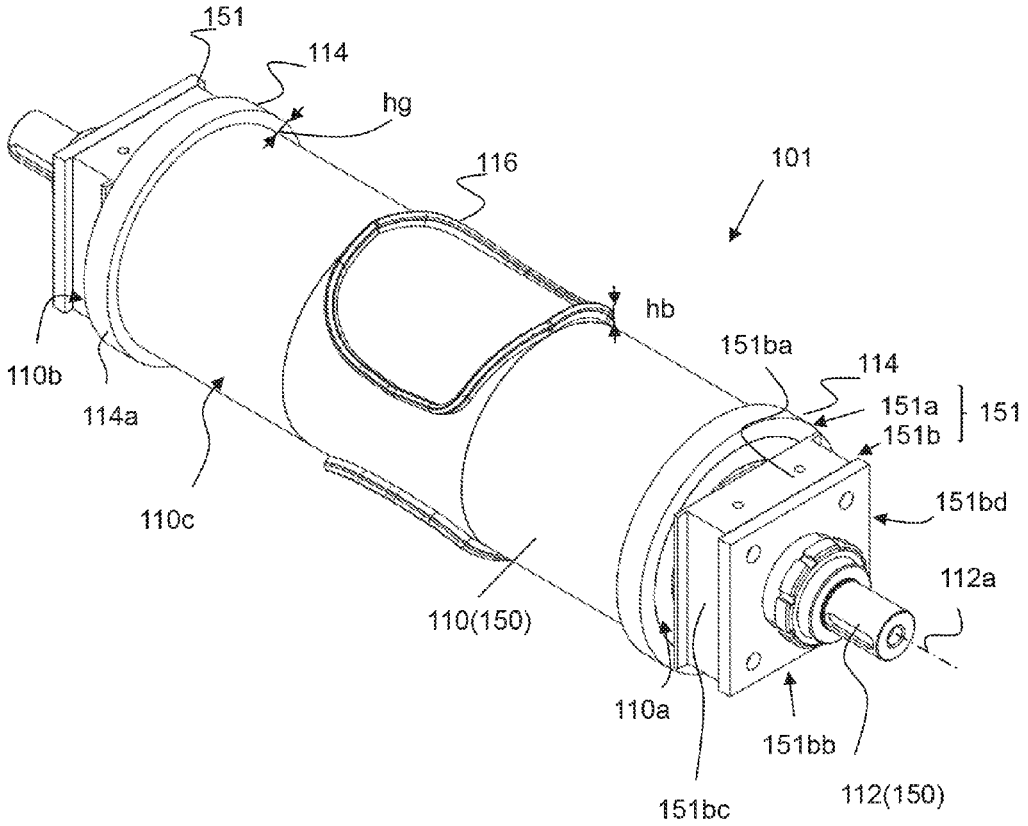
FIGS. 2A and 2B are perspective views of a cutter roll and an anvil roll, respectively, of the rotary cutter shown in FIG. 1.
Figure 2B:
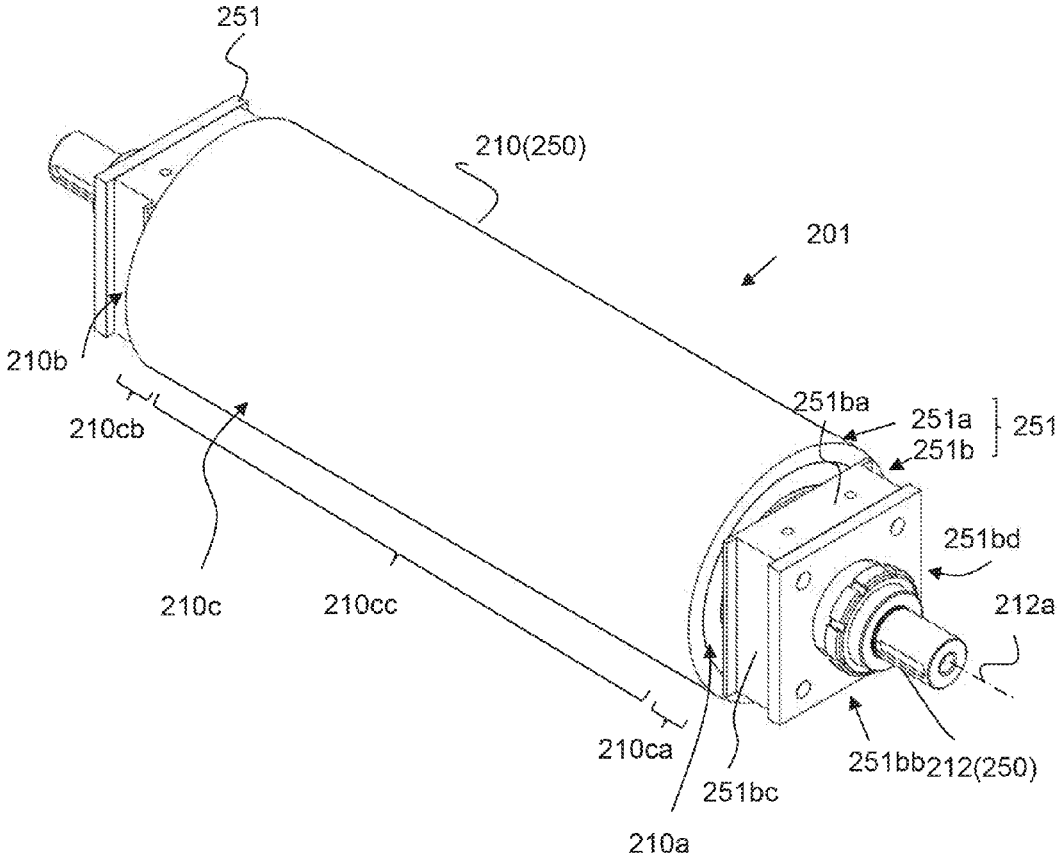

FIG. 1 is a perspective view schematically showing a rotary cutter according to a first embodiment of the present disclosure. A rotary cutter 11 includes a cutter roll 101, an anvil roll 201, a support frame 301, and a pressure mechanism 401. FIGS. 2A and 2B are perspective views of the cutter roll 101 and the anvil roll 201, respectively.

The cutter roll 101 includes a main body 150 having a barrel portion 110 and a pair of shafts 112, and a bearing structure 151. The barrel portion 110 of the main body 150 has a circumferential surface 110*c* and end surfaces 110*a* and 110*b* located at the opposite ends of the circumferential surface 110*c*. The end surfaces 110*a* and 110*b* each have a circular shape. The circumferential surface 110*c* is the side surface of a cylinder or a tube of which the upper and lower surfaces correspond to the end surfaces 110*a* and 110*b*. In the main body 150, each shaft 112 is connected to the barrel portion 110 and has a rotation axis 112*a* that coincides with the axis of the circumferential surface 110*c*. In the present embodiment, the shaft 112 is connected to each of the end surfaces 110*a* and 110*b* of the barrel portion 110, and has the rotation axis 112*a* that coincides with the axis of the circumferential surface 110*c*. That is, the main body 150 is a rotating member that is capable of rotating about the rotation axis 112*a* of the pair of the shafts 112. The rotation axis 112*a* will hereinafter be referred to also as the rotation axis of the cutter roll 101. It is to be noted that the cutter roll 101 has the pair of shafts 112 connected to end surfaces 110*a* and 110*b* of the barrel portion 110, respectively. However, the cutter roll 101 may have a single shaft that passes through the barrel portion 110. In this case, both end portions of the single shaft correspond to the pair of shafts 112.

A cutting blade 116 having a desired cutting shape is located on the circumferential surface 110*c* of the barrel portion 110. A guide ring 114 is provided at each of the opposite ends of the circumferential surface 110*c*. Each guide ring 114 extends over the entire circumference at one end of the circumferential surface 110*c*, and has a contact surface 114*a* located at a predetermined height hg from the surface of the circumferential surface 110*c*. The height hg is set to be generally equal to the height hb of the tip of the cutting blade 116 from the surface of the circumferential surface 110*c*. Then, it is possible to adjust the cutting load to be applied on the cutting blade when cutting the material. The contact surface 114*a* of the guide ring 114 can contact a circumferential surface 210*c* of the anvil roll so as to keep constant the interval between the cutter roll 101 and the anvil roll 201.

There is no particular limitation on the shape of the cutting blade 116 located between the guide rings 114 on the circumferential surface 110*c*. The cutting blade 116 has a shape corresponding to the outer shape of a cut-out piece. Although the cutting blade 116 is located at the center of the circumferential surface 110*c* in the axial direction in FIG. 2, the cutting blade 116 may be located near the opposite ends in the axial direction.

The bearing structure 151 includes a bearing portion 151*a* and a support portion 151*b*. The bearing portion 151*a* of the bearing structure 151 rotatably supports the shaft 112 of the main body 150. The support portion 151*b* includes support surfaces 151*ba* to 151*bd*, and at least one of the support surfaces 151*ba* to 151*bd* is in contact with, and is supported by, the support frame 301. How the shaft 112 is supported by the bearing structure 151 will be described below in detail.

The anvil roll 201 has a similar structure to that of the cutter roll 101 except that the cutting blade 116 and the guide rings 114 are absent. Specifically, the anvil roll 201 includes a main body 250 having a barrel portion 210 and a pair of shafts 212, and a bearing structure 251. The barrel portion 210 of the main body 250 has a circumferential surface 210*c* and end surfaces 210*a* and 210*b* located at the opposite ends of the circumferential surface 210*c*. The end surfaces 210*a* and 210*b* each have a circular shape. The circumferential surface 210*c* is the side surface of a cylinder or a tube which the upper and lower surfaces correspond to the end surfaces 210*a* and 210*b*. In the main body 250, the shaft 212 is connected to each of the end surfaces 210*a* and 210*b* of the barrel portion 210, and has a rotation axis 212*a* that coincides with the axis of the circumferential surface 210*c*. That is, the main body 250 is a rotating member that is capable of rotating about the rotation axis 212*a* of the pair of the shafts 212. The rotation axis 212*a* will hereinafter be referred to also as the rotation axis of the anvil roll 201.

Guide ring contact portions 210*ca* and 210*cb* of the circumferential surface 210*c* of the barrel portion 210 are located at the opposite ends of the circumferential surface 210*c* and are located so as to correspond to the guide rings 114 provided on the cutter roll 101 so that the contact surface 114*a* contacts the guide ring contact portions 210*ca* and 210*cb*. A blade receiving portion 210*cc* between the guide ring contact portion 210*ca* and a guide ring contact portion 210*cb* receives the cutting blade 116 provided on the cutter roll. To "receive the cutting blade 116", as used herein, encompasses cases where the cutting blade 116 comes into contact with the circumferential surface 210*c* in the blade receiving portion 210*cc* and also cases where the cutting blade 116 comes close to the circumferential surface 210*c* with a gap therebetween in the blade receiving portion 210*cc*.

As with the cutter roll 101, the bearing structure 251 also includes a bearing portion 251*a* and a support portion 251*b*. The bearing portion 251*a* of the bearing structure 251 rotatably supports the shaft 212 of the main body 250. The support portion 251*b* includes support surfaces 251*ba* to 251*bd*, and at least one of the support surfaces 251*ba* to 251*bd* is in contact with, and is supported by, the support frame 301. One of the support surfaces 251*ba* to 251*bd* is in contact with the pressure mechanism 401. How the shaft 212 is supported by the bearing structure 251 will also be described below in detail.

The length in the axial direction of the barrel portion 110 of the cutter roll 101 and that of the barrel portion 210 of the anvil roll 201 can be determined depending on the size of the pattern of the cut-out piece. The diameter of the circumferential surface 110*c* and that of the circumferential surface 210*c* can also be determined depending on the size of the pattern of the cut-out piece. The diameter of the circumferential surface 110*c* and the diameter of the circumferential surface 210*c* may be different from each other. On the other hand, the length in the axial direction of the barrel portion 110 is preferably equal to the length in the axial direction of the barrel portion 210.

Figure 3:
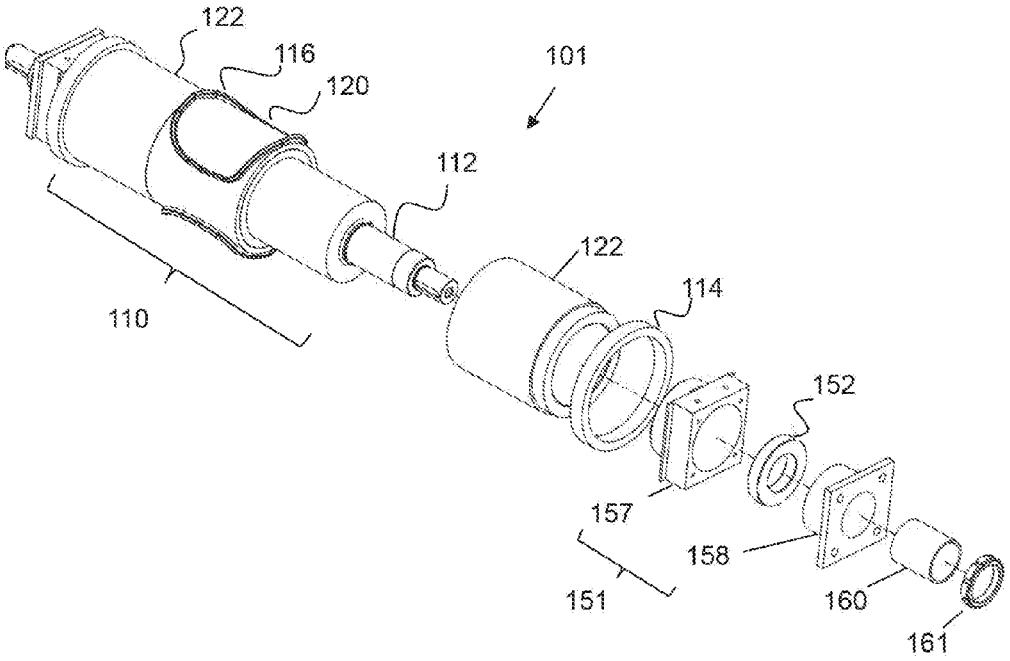
FIG. 3 is a partially exploded perspective view of the cutter roll shown in FIG. 2A.

FIG. 3 is a partially exploded perspective view showing a specific configuration of the cutter roll 101. In the example shown in FIG. 3, the barrel portion 110 of the cutter roll 101 is composed of a cutter portion 120 where the cutting blade 116 is provided, and spacer collars 122. The spacer collars 122 are optional, and the barrel portion 110 may not include spacer collars. In cases where the cutting blade 116 uses a cemented carbide, the cutter portion 120 may use a cemented carbide while spacers, etc., use another metal. The cemented carbide may be, for example, a WC—Co alloy, a WC—Ni alloy, or an alloy obtained by adding a carbide of Cr, V, Nb or Ta, or a metal binder, to these alloys. In such a case, the guide rings 114 preferably also use a cemented carbide. The barrel portion 210 of the anvil roll 201 may use a cemented carbide. The anvil roll 201 and other members may use steel materials, such as chrome molybdenum steel, carbon steel, high carbon chromium bearing steel and nickel chrome molybdenum steel. A configuration of the cutter roll 101 using a plurality of steel materials is disclosed in Japanese Laid-Open Patent Publication No. 2014-121763 of the present applicant, for example. In the cutter roll 101 and the anvil roll 201, the barrel portion 110 may have a tubular shape with a space inside, or may be of a cylindrical material with no space inside. The barrel portion 110 and the shaft may be formed as an integral part or as separate members.

Figure 4A:
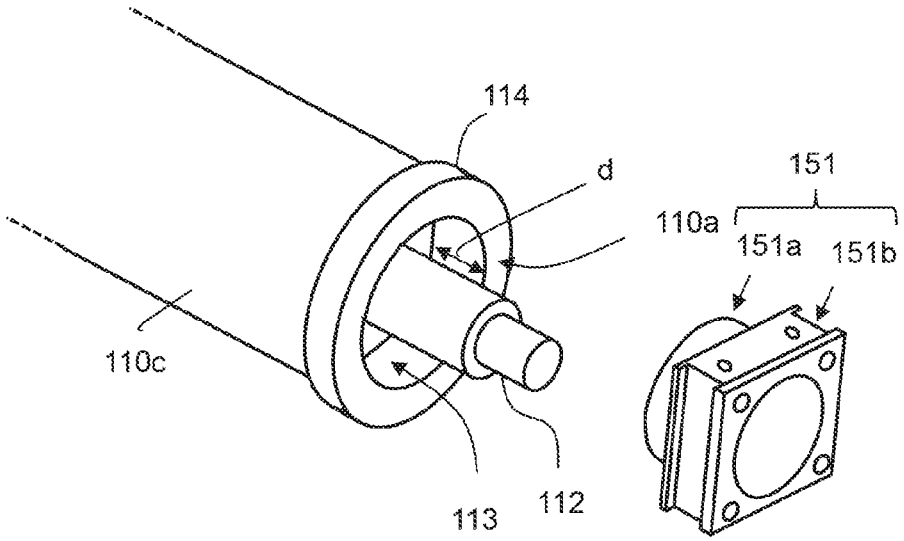
FIGS. 4A and 4B are perspective views of the cutter roll and the anvil roll, respectively, of the rotary cutter shown in FIG. 1, with a bearing structure removed from one end thereof.
Figure 4B:
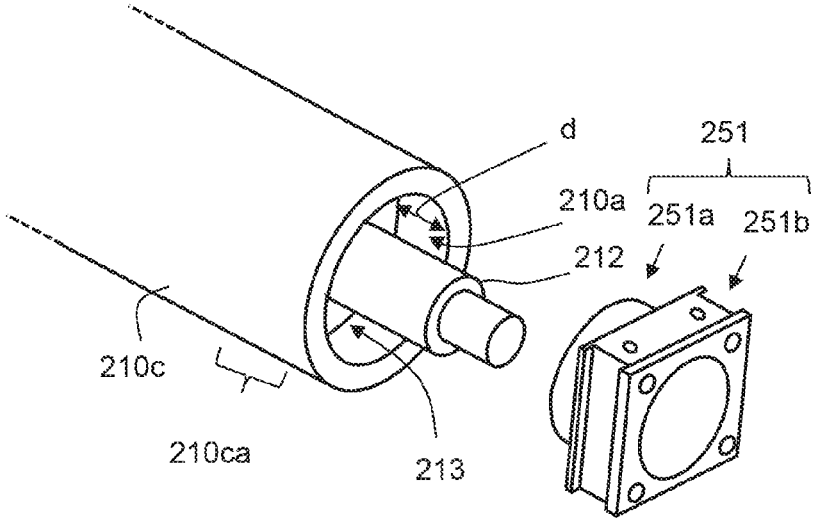
Figure 5A:
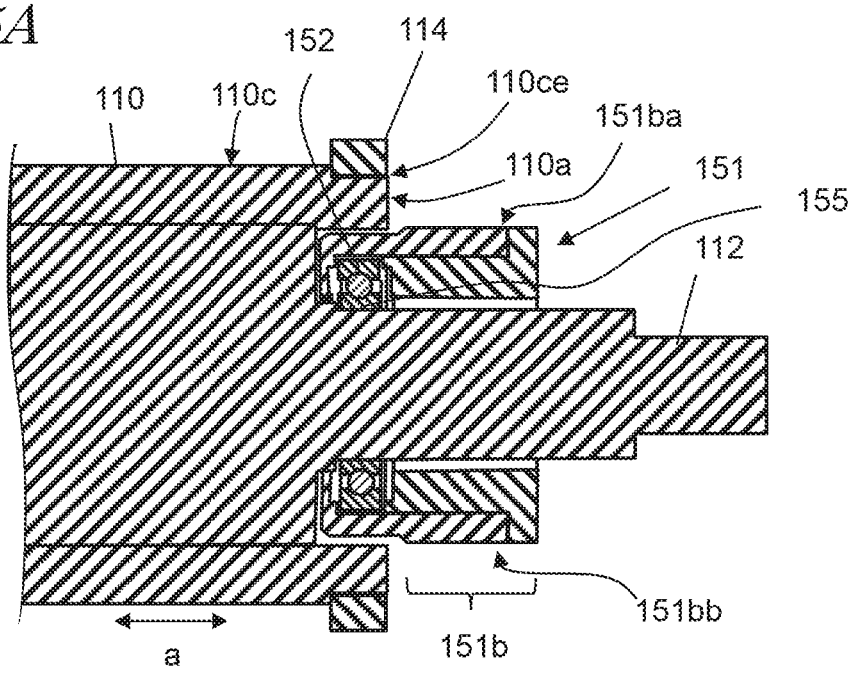
FIGS. 5A, 5B and 5C are a cross-sectional view showing the vicinity of one end of the cutter roll, a cross-sectional view showing the vicinity of one end of a cutter roll 101 with a bearing structure 151 removed therefrom, and a cross-sectional view showing the bearing structure, respectively.
Figure 5B:
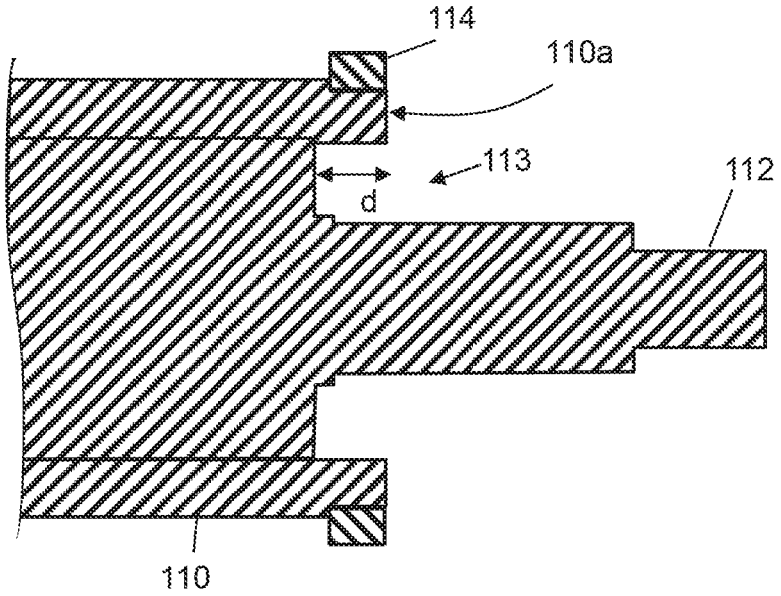
Figure 5C:
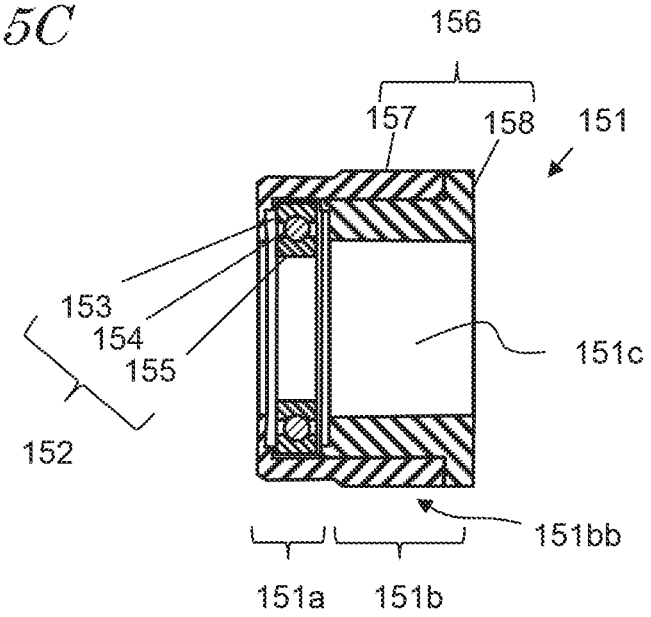

FIG. 4A is a perspective view showing the vicinity of one end of the cutter roll 101 with the bearing structure 151 removed therefrom. FIGS. 5A, 5B and 5C are a cross-sectional view showing the vicinity of one end of the cutter roll 101, a cross-sectional view showing the vicinity of one end of the cutter roll 101 with the bearing structure 151 removed therefrom, and a cross-sectional view showing the bearing structure, respectively. The bearing structure 251 and how the cutter roll 101 is supported by the bearing structure 251 will be described with reference to these figures.

As shown in FIG. 4A and FIG. 5B, a ring-shaped depression (first depression) 113 having a ring shape extending around the shaft 112 is provided at the end surface 110*a* of the barrel portion 110. The ring-shaped depression 113 has a depth direction d that is parallel to the rotation axis 112*a* of the shaft 112, and the ring-shaped opening of the ring-shaped depression 113 is located at the end surface 110*a*. That is, the ring-shaped depression 113 is arranged at the end surface 110*a*. Although not shown in the figures, the ring-shaped depression 113 having a ring shape extending around the shaft 112 is provided also at the end surface 110*b*. The shaft 112 extending from the end surface 110*a* toward the center in the axial direction a is located at the center of the ring-shaped depression 113.

As shown in FIG. 5C, the bearing structure 151 includes a bearing 152 and a bearing box 156. The bearing 152 typically includes an outer race 153, an inner race 155 and a rolling element 154. The bearing 152 may be any of radial bearings of various structures. The bearing box 156 includes a tubular portion corresponding to the bearing portion 151*a*, and a rectangular portion corresponding to the support portion 151*b*, and the bearing box 156 is composed of a bearing holder 157 and a bearing cover 158. The bearing 152 is accommodated in the internal space of the tubular portion of the bearing holder 157, and is secured by the bearing cover 158. The support surfaces 151*ba* to 151*bd* to be in contact with the support frame 301 or the pressure mechanism 401 are located on the rectangular portion of the bearing holder 157. The bearing box 156 has a through hole, through which the shaft 112 is inserted.

As shown in FIG. 5A, a part or whole of the bearing portion 151*a* of the bearing structure 151 is inserted into the ring-shaped depression 113 provided at the end surface 110*a* of the barrel portion 110, and the inner race 155 of the bearing 152 is in contact with the side surface of the shaft 112. The bearing 152 is located so that at least a portion thereof is on the inner side (closer to the center of the barrel portion 110) of an end portion 110*ce* of the circumferential surface 110*c* in the axial direction a of the barrel portion 110. In the present embodiment, the entirety of the bearing 152 is located on the inner side of the end portion 110*ce*. Therefore, the bearing 152 is arranged so as to at least partially overlap with the guide ring 114 in the axial direction a of the circumferential surface 110*c*. In the present embodiment, the center of the guide ring 114 coincides with the center of the bearing 152 in the axial direction a of the circumferential surface 110*c*. On the other hand, the support portion 151*b* to be in contact with the support frame 301 or the pressure mechanism 401 is located on the outer side of the ring-shaped depression 113. The support portion 151*b* including the support surfaces 151*ba* to 151*bd* is located on the outer side of the guide ring 114 in the axial direction a.

As shown in FIG. 3, in order to secure the bearing structure 151 in the axial direction of the barrel portion 110, a lock collar 160 is fitted over the shaft 112 and is secured by a lock nut 161. The bearing structure 151 is similarly inserted into the ring-shaped depression 113 provided at the end surface 110*b* of the barrel portion 110.

FIG. 4A is a perspective view showing the vicinity of one end of the anvil roll 201 with the bearing structure 251 removed therefrom. FIGS. 5A, 5B and 5C are a cross-sectional view showing the vicinity of one end of the anvil roll 201, a cross-sectional view showing the vicinity of one end of the anvil roll 201 with the bearing structure 251 removed therefrom, and a cross-sectional view of the bearing structure, respectively.

A ring-shaped depression 213 having a ring shape extending around the shaft 212 is provided also at the end surface 210*a* and the end surface 210*b* of the barrel portion 210 of the anvil roll 201. The ring-shaped depression 113 has a depth direction d that is parallel to the rotation axis 112*a* of the shaft 112.

Figure 6A:
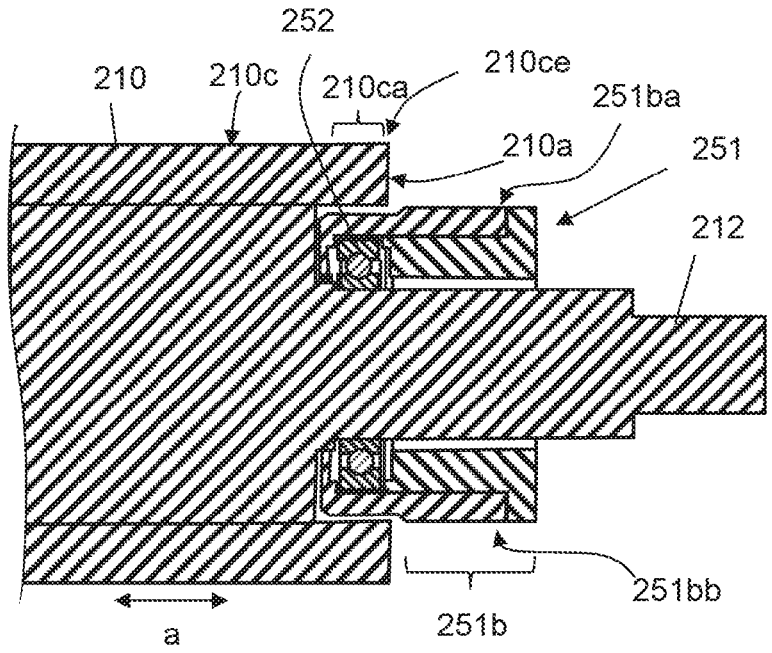
FIGS. 6A, 6B and 6C are a cross-sectional view showing the vicinity of one end of an anvil roll, a cross-sectional view showing the vicinity of one end of the cutter roll 101 with the bearing structure 151 removed therefrom, and a cross-sectional view showing the bearing structure, respectively.
Figure 6B:
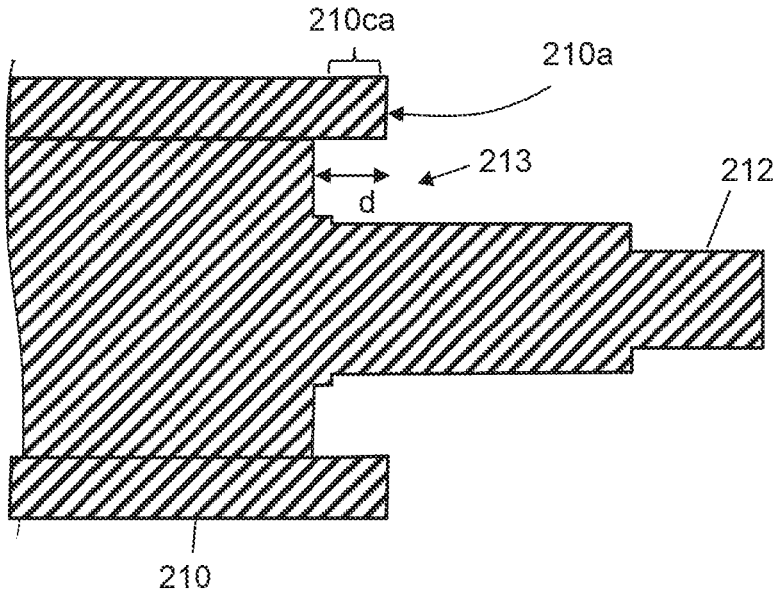
Figure 6C:
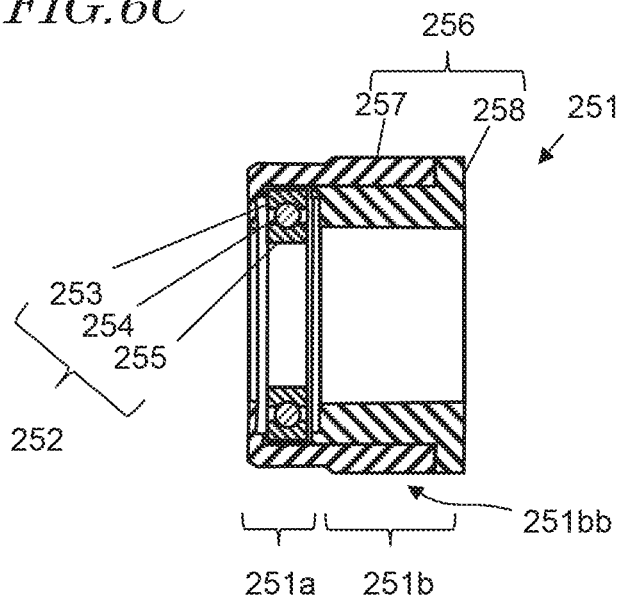

As does the bearing structure 251, the bearing structure 251 includes a bearing 252 and a bearing box 256, as shown in FIG. 6C. The bearing 252 includes an outer race 253, an inner race 255 and a rolling element 254. The bearing box 256 includes a tubular portion corresponding to the bearing portion 251*a*, and a rectangular portion corresponding to the support portion 251*b*, and the bearing box 256 is composed of a bearing holder 257 and a bearing cover 258. The bearing box 256 has a through hole, through which the shaft 212 is inserted.

As shown in FIG. 6A, a portion of the bearing portion 251*a* of the bearing structure 251 is inserted into the ring-shaped depression 113 provided at the end surface 210*a* of the barrel portion 210, and the inner race 255 of the bearing 252 is in contact with the side surface of the shaft 212. The bearing 252 is located so that at least a portion thereof is on the inner side (closer to the center of the barrel portion 210) of an end portion 210*ce* of the circumferential surface 210*c* in the axial direction a of the barrel portion 210. In the present embodiment, the entirety of the bearing 252 is located on the inner side of the end portion 210*ce*. Therefore, the bearing 252 is arranged so as to at least partially overlap with the guide ring contact portion 210*ca* in the axial direction a of the circumferential surface 110*c*. In the present embodiment, the center of the guide ring contact portion 210*ca* coincides with the center of the bearing 152 in the axial direction a of the circumferential surface 110*c*. The support portion 251*b* to be in contact with the support frame 301 or the pressure mechanism 401 is located on the outer side of the ring-shaped depression 113. That is, the support portion 251*b* including the support surfaces 251*ba* to 251*bd* is located on the outer side of the guide ring contact portion 210*ca* in the axial direction a.

Thus, the ring-shaped depression 113 (213) provided on the cutter roll 101 (the anvil roll 201) is located on the inside of the circumferential surface 110*c* (210*c*). Therefore, by varying the depth d of the ring-shaped depression 113 (213), the bearing 152 (252) can be arranged at any position in the axial direction a without interfering the guide ring 114 (the guide ring contact portions 210*ca* and 210*cb*) and the cutting blade 116 (the blade receiving portion 210*cc*).

Figure 7A:
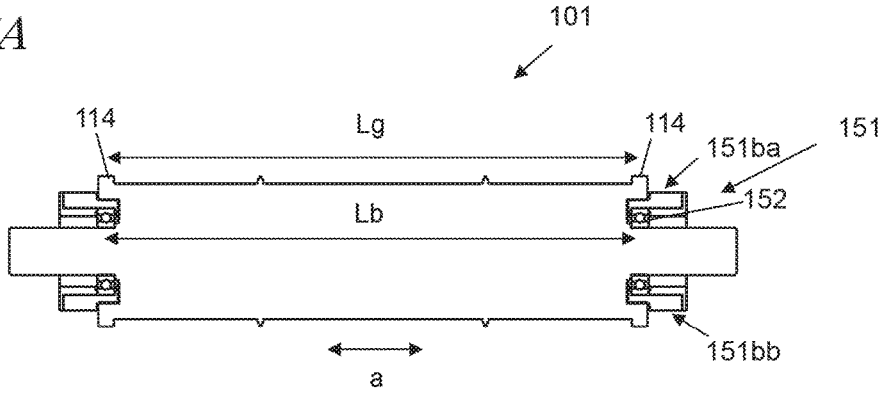
FIGS. 7A, 7B and 7C are schematic cross-sectional views of the cutter roll, the anvil roll and the rotary cutter, respectively, of the first embodiment.
Figure 7B:
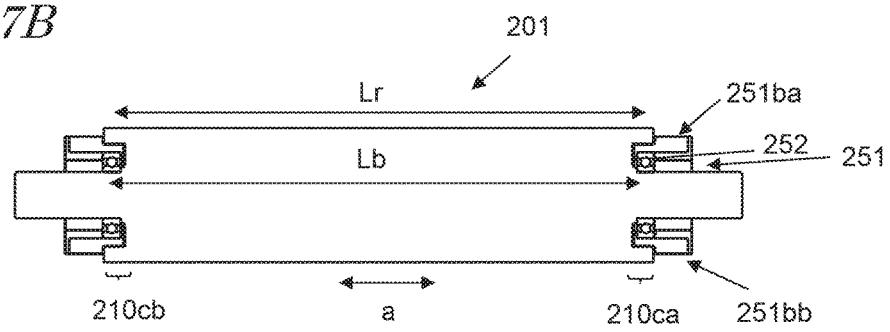

FIGS. 7A and 7B are schematic cross-sectional views of the cutter roll 101 and the anvil roll 201, respectively. In the present embodiment, for the cutter roll 101, the interval Lg between the pair of guide rings 114 in the axial direction a is equal to the interval Lb between the pair of bearings 152. Herein, the interval Lg and the interval Lb are each defined as a center interval.

Specifically, the interval Lg is the center distance between the pair of guide rings 114 in the axial direction a, and the interval Lb is the center distance between the pair of bearings 152 in the axial direction a. Similarly, for the anvil roll 201, the interval Lr between the pair of guide rings contact portions 210*ca* and 210*cb* in the axial direction a is equal to the interval Lb between the pair of bearings 152.

The cutter roll 101 and the anvil roll 201 are supported by the support frame 301. For example, as shown in FIG. 1, the support frame 301 includes a pair of slits 301*a* and 301*b* arranged with a predetermined interval therebetween, and the support portion 151*b* of the cutter roll 101 and the support portion 251*b* of the anvil roll 201 are inserted into the slits 301*a* and 301*b*. The cutter roll 101 and the anvil roll 201 are arranged so that the rotation axis 112*a* of the shaft 112 of the cutter roll 101 is parallel to the rotation axis 212*a* of the shaft 212 of the anvil roll 201.

A support surface 251*bb* of the bearing structure 251 of the anvil roll 201 is in contact with the pressure mechanism 401. The pressure mechanism 401 is a hydraulic or pneumatic cylinder, a mechanical pressure device, a spring, etc., and applies a load on the support surface 251*bb* in such a manner that the rotation axis 212*a* of the anvil roll 201 comes closer to the rotation axis 112*a* of the cutter roll 101.

The support surface 151*ba* of the bearing structure 151 of the cutter roll 101 is in contact with a spacer block 302 inserted in the pair of slits 301*a* and 301*b*.

Support surfaces 151*bc* and 151*bd* of the cutter roll 101 and support surfaces 251*bc* and 251*bd* of the anvil roll 201 are in contact with the inner surface of the slits 301*a* and 301*b*. Therefore, when the pressure mechanism 401 applies a load on a support surface 252*bb* of the anvil roll 201, the anvil roll 201 is pressed against the cutter roll 101.

The shaft 112 of the cutter roll 101 of the rotary cutter 11 is provided with gears, pulleys, etc., so that the rotational driving force from a drive source such as a motor is transmitted to the shaft 112 via gears and belts. Thus, the cutter roll 101 rotates. The anvil roll 201 rotates in the opposite direction to that of the cutter roll 101 by virtue of a friction force received from the contact surface 114*a* of the guide ring 114, for example. The rotational driving force from the drive source may also be transmitted to the shaft 212 of the anvil roll 201 to rotate the anvil roll 201 in synchronization with the rotation of the cutter roll 101.

While the cutter roll 101 and the anvil roll 201 are rotating, a material to be cut, such as a web of cloth, paper, non-woven fabric, resin, metal foil, etc., is passed through between the cutter roll 101 and the anvil roll 201 to continuously cut out cut-out pieces each having a shape delimited by the cutting blade 116.

Figure 7C:
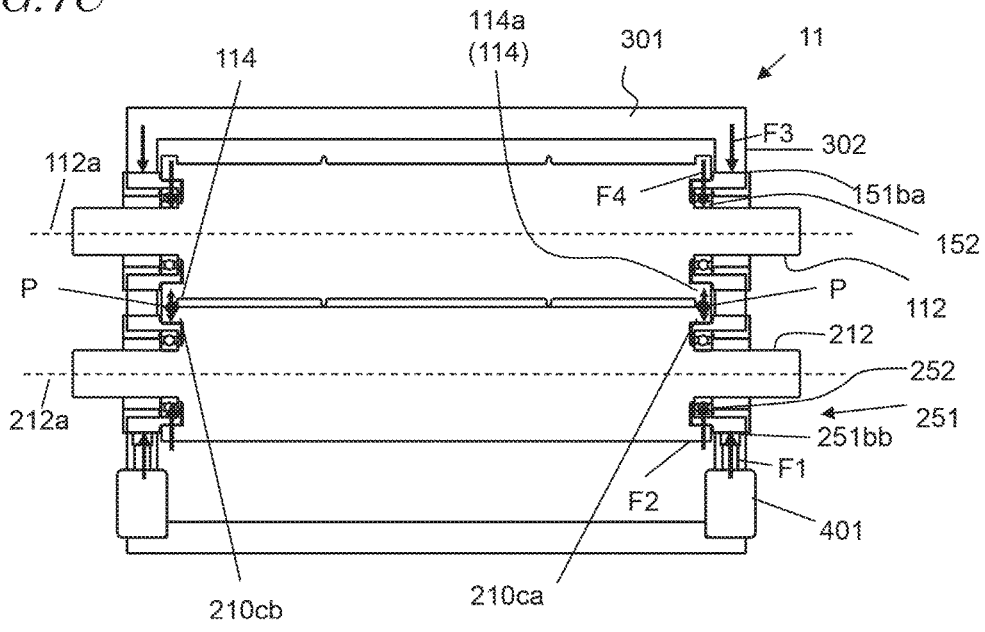

Next, the deflection of the cutter roll 101 and the anvil roll 201 of the rotary cutter 11 will be described. FIG. 7C shows a schematic cross section of the rotary cutter 11 taken along a plane that includes the rotation axis 112*a* of the cutter roll 101 and the rotation axis 212*a* of the anvil roll 201. For the sake of simplicity, the cross section is not hatched in the figure.

As shown in FIG. 7C, a force F1, resulting from the pressure mechanism 401 applying a pressure on the support surface 251*bb* of the bearing structure 251, is transmitted, as a force F2, to the shaft 212 of the anvil roll 201 via the bearing 252. The force F1 from the pressure mechanism 401 eventually produces a reaction force F3 from the spacer block 302 of the support frame 301. The reaction force F3 is transmitted to the support surface 151*ba* of the bearing structure 151 of the cutter roll 101, and is transmitted, as a force F4, to the shaft 112 of the cutter roll 101 via the bearing 152.

The cutter roll 101 and the anvil roll 201 each have a gravitational force acting thereon by virtue of its own weight. At a fulcrum P where the contact surface 114*a* of the guide ring 114 is in contact with the guide ring contact portions 210*ca* and 210*cb*, the cutter roll 101 and the anvil roll 201 are supported against each other, with the gravitational forces acting on the cutter roll 101 and the anvil roll 201 being canceled out by the force F2 and the force F4.

As described above, the center of the guide ring 114 and the center of the bearing 152 coincide with each other in the axial direction a of the cutter roll 101. Also, the center of the guide ring contact portions 210*ca* and 210*cb* and the center of the bearing 252 coincide with each other in the axial direction a of the anvil roll 201. That is, there is substantially no bending moment on the anvil roll 201 since the force F2 acts at the position of the fulcrum P, and there is substantially no deformation of the anvil roll 201 because of the force F2. Similarly, there is substantially no deformation (deflection) of the cutter roll 101 because of the force F4 since the force F4 acts at the position of the fulcrum P.

Thus, the deflection of the cutter roll 101 and the anvil roll 201 is reduced, and it is possible to keep the rotation axis 112*a* of the cutter roll 101 and the rotation axis 212*a* of the anvil roll 201 parallel to each other. That is, the gap between the circumferential surface 110*c* of the cutter roll 101 and the circumferential surface 210*c* of the anvil roll 201 is substantially constant across the entire extent in the axial direction a. Therefore, according to the present embodiment, there is a constant load on the cutting blade 116 in the axial direction of the cutter roll 101, and it is possible to realize a uniform cutting quality. Particularly, even when the cutter roll 101 and the anvil roll 201 are thin rolls having small diameters, a uniform cutting quality can be realized. Thus, it is possible to cut out cut-out pieces, leaving substantially no pieces uncut (unpunched). Since the load acting on the cutting blade 116 is constant in the axial direction of the cutter roll 101, it is possible to reduce the possibility of the cutting blade 116 chipping because of an excessive load on a portion of the cutting blade 116. Thus, it is possible to elongate the life of the cutter roll 101 and the continuous operation time of the rotary cutter 11, and it is possible to reduce the frequency of maintenance for the rotary cutter 11 or reduce the interruption of manufacture due to maintenance. Particularly, it is possible to further enhance the high productivity which is characteristic of rotary cutters.

According to the present embodiment, the side surface of the shaft of the cutter roll 101 and the anvil roll 201 is supported by the inner race of the bearing, and it is therefore possible to use relatively small bearings and reduce the manufacturing cost of the cutter roll 101 and the anvil roll 201. Since the rotation axis of the cutter roll 101 and that of the anvil roll 201 can be kept parallel to each other, it is possible, even with increased roll lengths, to appropriately keep the interval between the cutting blade provided on the cutter roll 101 and the anvil roll 201, thereby realizing a uniform cutting quality.

Also, as explained above, the bearing structures 151 and 251 are partially or fully inserted into the ring-shaped depressions 113 provided at the end surface 110*a* and 110*b* of the cutter roll 101 and the anvil roll 201. Therefore, the arrangement of the bearing structures 151 and 251 can prevent the cutter roll 101 and the anvil roll 201 from elongating along the axis direction thereof, while the various advantageous effects can be obtained with a width of an apparatus which is substantially equal to that of a conventional rotary cutter.

(Second Embodiment)

Figure 8A:
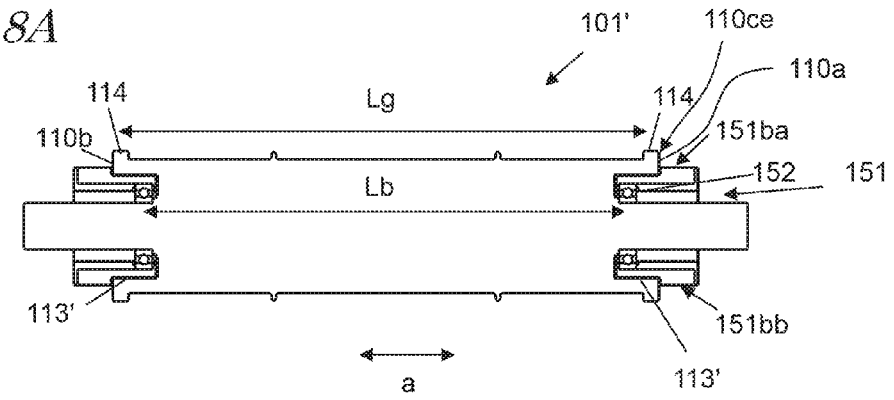
FIGS. 8A, 8B and 8C are schematic cross-sectional views of a cutter roll, an anvil roll and a rotary cutter, respectively, of a second embodiment.
Figure 8B:
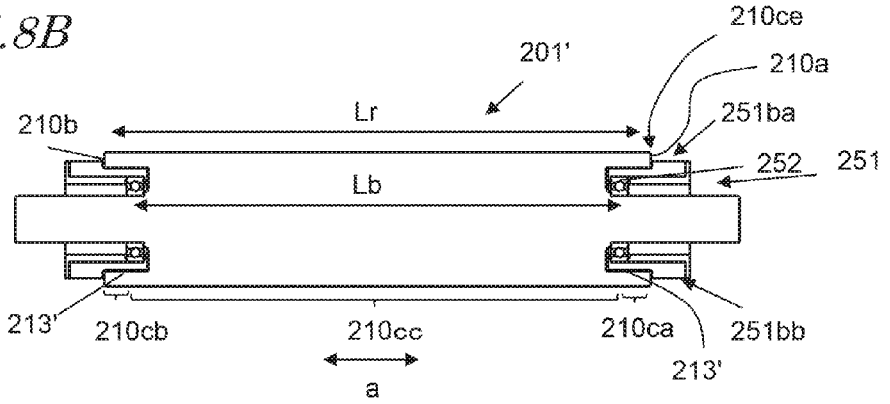
Figure 8C:
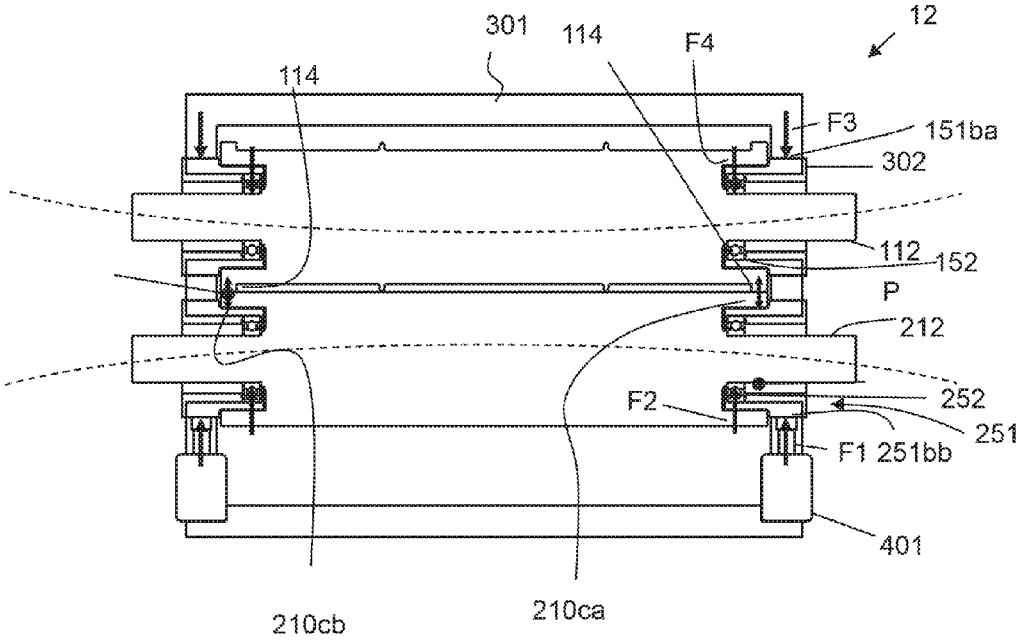

FIGS. 8A, 8B and 8C are schematic cross-sectional views of a cutter roll 101', an anvil roll 201' and a rotary cutter 12, respectively, of a rotary cutter according to a second embodiment of the present disclosure. As shown in FIGS. 8A and 8B, the cutter roll 101' is different from the cutter roll 101' of the first embodiment in that a ring-shaped depression 113' that is deeper than that of the first embodiment is provided at the end surfaces 110*a* and 110*b*. Specifically, the depth of the ring-shaped depression 113' in the axial direction a is greater than that of the first embodiment. Therefore, the bearing 152 is located closer to the center in the axial direction a than the guide ring 114. In other words, the bearing 152 is located further away from the end portion 110*ce* than the guide ring 114. This similarly applies to the positions of the ring-shaped depression 113' and the bearing 152 provided at the end surface 110*b*. Therefore, for the cutter roll 101', the interval Lg between the pair of guide rings 114 in the axial direction a is greater than the interval Lb between the pair of bearings 152.

As shown in FIG. 8B, for the anvil roll 201', the depth of the ring-shaped depression 113' in the axial direction a is greater than that of the first embodiment. Therefore, the bearing 252 is located closer to the center in the axial direction a than the guide ring contact portions 210*ca* and 210*cb*, and the interval Lr between the pair of guide rings contact portions 210*ca* and 210*cb* in the axial direction a is greater than the interval Lb between the pair of bearings 152. Since the bearing 252 is located on the inside of a circumferential surface 201*c*, the bearing 252 is not located between the blade receiving portion 210*cc* and the guide ring contact portions 210*ca* and 210*cb*, and the blade receiving portion 210*cc* is adjacent to, and in contact with, the guide ring contact portions 210*ca* and 210*cb*.

Next, referring to FIG. 8C, the deflection of the cutter roll 101' and the anvil roll 201' of the rotary cutter 12 will be described. As in the first embodiment, the force F1, resulting from the pressure mechanism 401 applying a pressure on the support surface 251*bb* of the bearing structure 251, is transmitted, as the force F2, to the shaft 212 of the anvil roll 201' via the bearing 252.

On the other hand, the reaction force F3 applies a pressure on the support surface 151*bb* of the bearing structure 151 of the cutter roll 101'. The reaction force F3 is transmitted, as the force F4, to the shaft 112 of the cutter roll 101' via the bearing 152.

As the contact surface 114*a* of the guide ring 114 and the guide ring contact portions 210*ca* and 210*cb* are in contact with each other, the cutter roll 101' and the anvil roll 201' are supported against each other at the fulcrum P by virtue of the force F2 and the force F4. As described above, the bearing 152 is located closer to the center in the axial direction a of the cutter roll 101 than the guide ring 114. The bearing 252 is located closer to the center in the axial direction a of the anvil roll 201 than the guide ring contact portions 210*ca* and 210*cb*.

Thus, the force F2 acts on a portion of the anvil roll 201' that is closer to the center than the fulcrum P, thereby producing a bending moment. As a result, as indicated by a broken line, the anvil roll 201' is bent toward the cutter roll 101'. Similarly, the force F4 acts on a portion of the cutter roll 101' that is closer to the center than the fulcrum P, thereby bending the cutter roll 101' toward the anvil roll 201', as indicated by a broken line.

As a result, with the rotary cutter 12 of the present embodiment, the cutter roll 101' and the anvil roll 201' are bent in such a manner that the interval therebetween is narrower toward the center. Such a configuration is preferable, for example, in cases where the line density of the cutting blade 116 in the circumferential direction of the circumferential surface 110*c* of the cutter roll 101' is higher near the center in the axial direction a. Considering only the load from the pressure mechanism 401, a greater load will be applied to the cutting blade 116 near the center in the axial direction a, as described above. However, with the line density of the cutting blade 116 in the circumferential direction of the circumferential surface 110*c* also taken into consideration, the load on the cutting blade 116 may be substantially uniform in the axial direction a. Therefore, according to the present embodiment, when the line density of the cutting blade 116 in the circumferential direction of the circumferential surface 110*c* is higher near the center of the cutter roll 101', the load on the cutting blade 116 is uniform, thereby realizing a uniform cutting quality. Thus, it is possible to cut out cut-out pieces, leaving substantially no pieces uncut (unpunched).

According to the present embodiment, while the bearing 152 of the cutter roll 101' and the bearing 252 of the anvil roll 201' are located closer to the center in the axial direction a than the guide rings 114 and the guide ring contact portions 210*ca* and 210*cb*, respectively, they are absent on a circumferential surface 101*c* and the circumferential surface 201*c*. Therefore, the cutting blade 116 can be provided across the entirety of an area of the circumferential surface 101*c* that is sandwiched between the guide rings 114. Moreover, the entirety of the area between the guide ring contact portion 210*ca* and the guide ring contact portion 210*cb* can be used as the blade receiving portion 210*cc*. Therefore, with the cutter roll 101' and the anvil roll 201', it is possible to ensure a large area for the cutting blade 116 and the blade receiving portion even though the bearings 152 and 252 are located toward the center in the axial direction a.

(Third Embodiment)

Figure 9A:
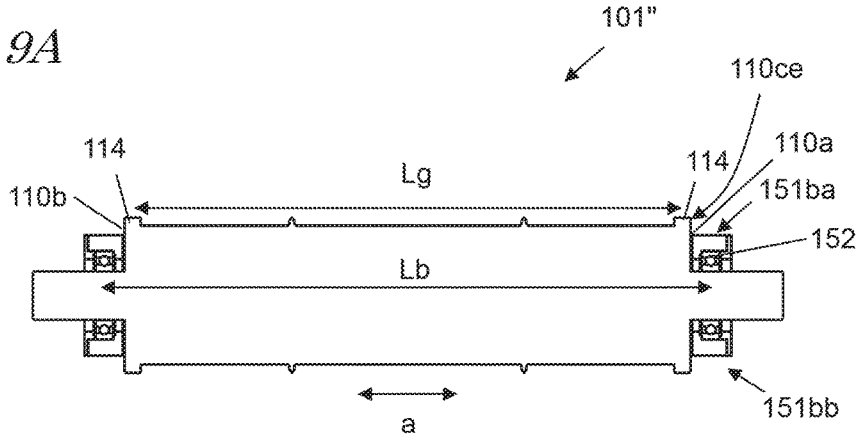
FIGS. 9A and 9B are schematic cross-sectional views of a cutter roll and a rotary cutter, respectively, of a third embodiment.
Figure 9B:
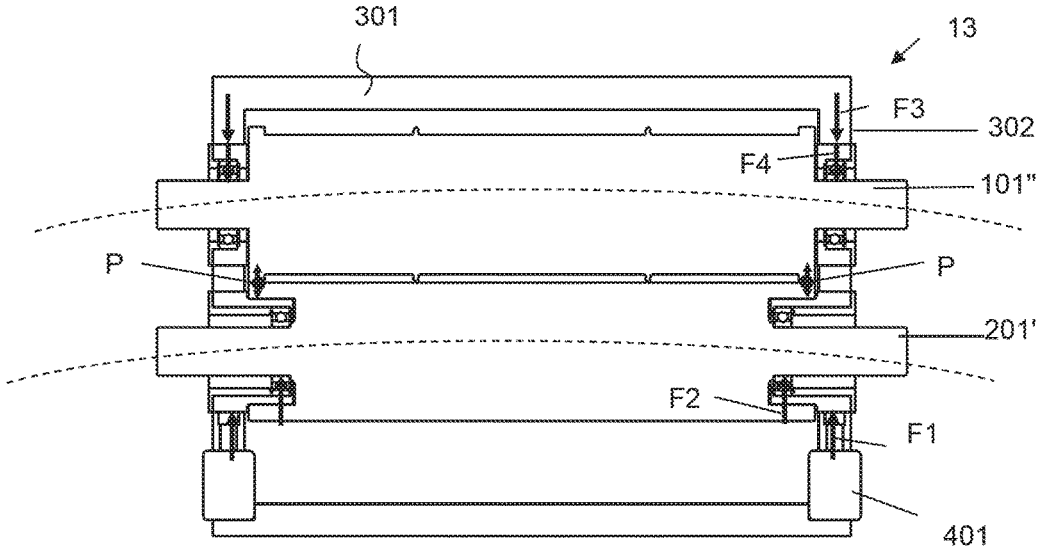

FIGS. 9A and 9B are schematic cross-sectional views of a cutter roll 101" and a rotary cutter 13, respectively, of a rotary cutter according to a third embodiment of the present disclosure. As shown in FIG. 9A, the cutter roll 101" is different from the cutter roll 101' of the first embodiment in that the ring-shaped depression 113 is not provided at the end surfaces 110*a* and 110*b*. Specifically, the bearing 152 is located on the outer side of the end surface 110*a* in the axial direction a, supporting the side surface of the shaft 112.

Thus, the bearing 152 is located on the outer side in the axial direction a than the guide ring 114, and the interval Lg between the pair of guide rings 114 in the axial direction a is smaller than the interval Lb between the pair of bearings 152. Moreover, the position at which the pair of bearings 152 support the side surface of the shaft 112 generally coincides, in the axial direction a, with the position of the support surface 151*ba* of the pair of bearings structure 151.

As shown in FIG. 9B, the rotary cutter 13 includes the anvil roll 201' of the second embodiment.

Next, referring to FIG. 9B, the deflection of the cutter roll 101" and the anvil roll 201' of the rotary cutter 13 will be described. As in the first embodiment, the force F1, resulting from the pressure mechanism 401 applying a pressure on the support surface 251*bb* of the bearing structure 251, is transmitted, as the force F2, to the shaft 212 of the anvil roll 201' via the bearing 252.

On the other hand, the reaction force F3 applies a pressure on the support surface 151*bb* of the bearing structure 151 of the cutter roll 101'. The reaction force F3 is transmitted, as the force F4, to the shaft 112 of the cutter roll 101' via the bearing 152.

As the contact surface 114*a* of the guide ring 114 and the guide ring contact portions 210*ca* and 210*cb* are in contact with each other, the cutter roll 101' and the anvil roll 201' are supported against each other at the fulcrum P by virtue of the force F2 and the force F4. As described above, the bearing 152 is located on the outer side in the axial direction a of the cutter roll 101" than the guide ring 114. The bearing 252 is located closer to the center in the axial direction a of the anvil roll 201 than the guide ring contact portions 210*ca* and 210*cb*.

Thus, the force F2 acts on a portion of the anvil roll 201' that is closer to the center than the fulcrum P, thereby bending the anvil roll 201' toward the cutter roll 101', as indicated by a broken line. On the other hand, the force F4 acts on a portion of the cutter roll 101" that is on the outer side of the fulcrum P, thereby bending the cutter roll 101" toward the anvil roll 201', as indicated by a broken line.

As a result, with the rotary cutter 12 of the present embodiment, the anvil roll 201' bends in conformity with the direction of deflection of the cutter roll 101'. Therefore, the interval between the cutter roll 101" and the anvil roll 201' can be constant in the axial direction. Therefore, as in the first embodiment, there is a constant load on the cutting blade 116 in the axial direction of the cutter roll 101", and it is possible to realize a uniform cutting quality. Thus, it is possible to cut out cut-out pieces, leaving substantially no pieces uncut (unpunched).

(Fourth Embodiment)

Figure 10A:
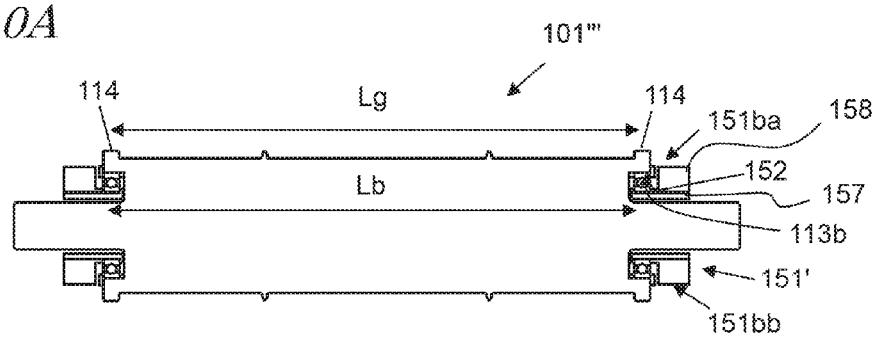
FIGS. 10A, 10B and 10C are schematic cross-sectional views of a cutter roll, an anvil roll and a rotary cutter, respectively, of a fourth embodiment.
Figure 10B:
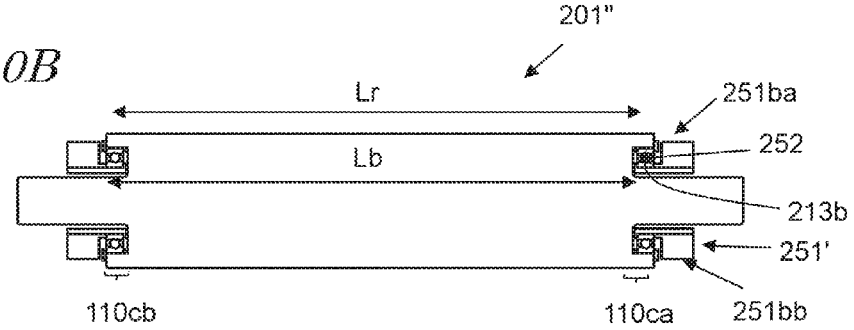
Figure 10C:
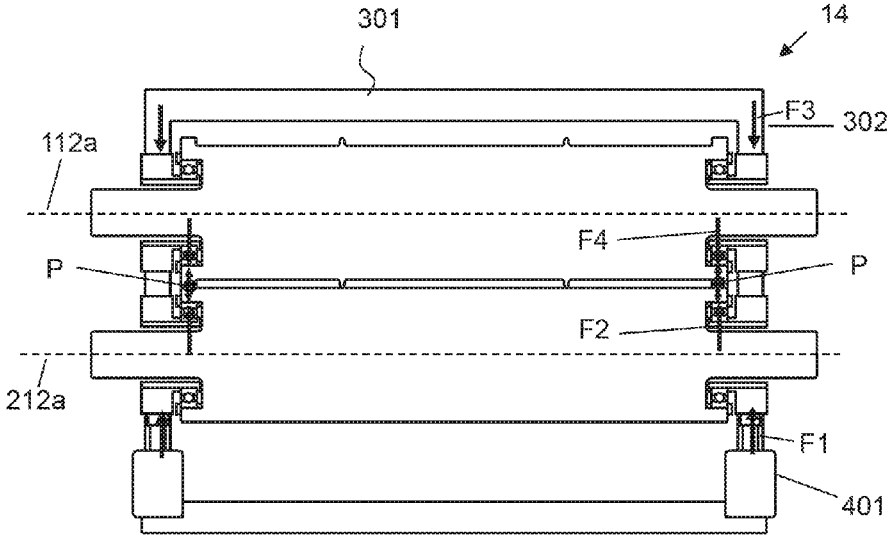

FIGS. 10A, 10B and 10C are schematic cross-sectional views of a cutter roll 101'", an anvil roll 201" and a rotary cutter 14, respectively, of a rotary cutter according to a fourth embodiment of the present disclosure. As shown in FIGS. 10A and 10B, the rotary cutter of the fourth embodiment is different from the first embodiment in that a bearing structure 151' of the cutter roll 101'" is in contact with an outer wall 113*b* of the ring-shaped depression 113 and a bearing structure 251' of the anvil roll 201" is in contact with an outer wall 213*b* of the ring-shaped depression 213. It is to be noted that the bearing of the bearing structure 251' is not in contact with the inner wall of the ring-shaped depression 113 (side surface of the shaft).

The bearing structure 151' includes the bearing holder 157 and the bearing cover 158 that hold the bearing 152 while the outer race 153 thereof is exposed, for example. As in the first embodiment, for the cutter roll 101'", the interval Lg between the pair of guide rings 114 in the axial direction a is equal to the interval Lb between the pair of bearings 152. Similarly, for the anvil roll 201", the interval Lr between the pair of guide rings contact portions 210*ca* and 210*cb* in the axial direction a is equal to the interval Lb between the pair of bearings 252.

As shown in FIG. 10C, in the rotary cutter 14, the force F1 is transmitted, as the force F2, to the outer wall 213*b* of the ring-shaped depression 213 of the anvil roll 201 via the bearing 252. The reaction force F3 is transmitted, as the force F4, to the outer wall 113*b* of the ring-shaped depression 113 of the cutter roll 101 via the bearing 152. The directions of the force F2 and the force F4 and the positions thereof in the axial direction a are the same as those of the first embodiment. Thus, the deflection of the cutter roll 101''' and the anvil roll 201" of the rotary cutter 14 is reduced, and the gap between the circumferential surface 110*c* of the cutter roll 101''' and the circumferential surface 210*c* of the anvil roll 201" is substantially constant across the entire extent in the axial direction a. Therefore, according to the present embodiment, there is a constant load on the cutting blade 116 in the axial direction of the cutter roll 101, and it is possible to realize a uniform cutting quality.

According to the present embodiment, since the guide ring 114 of the cutter roll 101''' and the guide ring contact portions 210*ca* and 201*cb* of the anvil roll 201" are supported from the inside by bearings, and the position of the fulcrum P at which the cutter roll 101''' and the anvil roll 201" apply forces upon each other coincides with the position in the axial direction a of the bearings supporting the cutter roll 101''' and the anvil roll 201", resulting in a small bending moment acting on the cutter roll 101''' and the anvil roll 201". Therefore, the deformation of the spacer collar 122 and the guide ring 114 of the cutter roll 101''' and the deformation near the guide ring contact portions 210*ca* and 201*cb* of the anvil roll 201" can be further reduced.

Figure 11A:
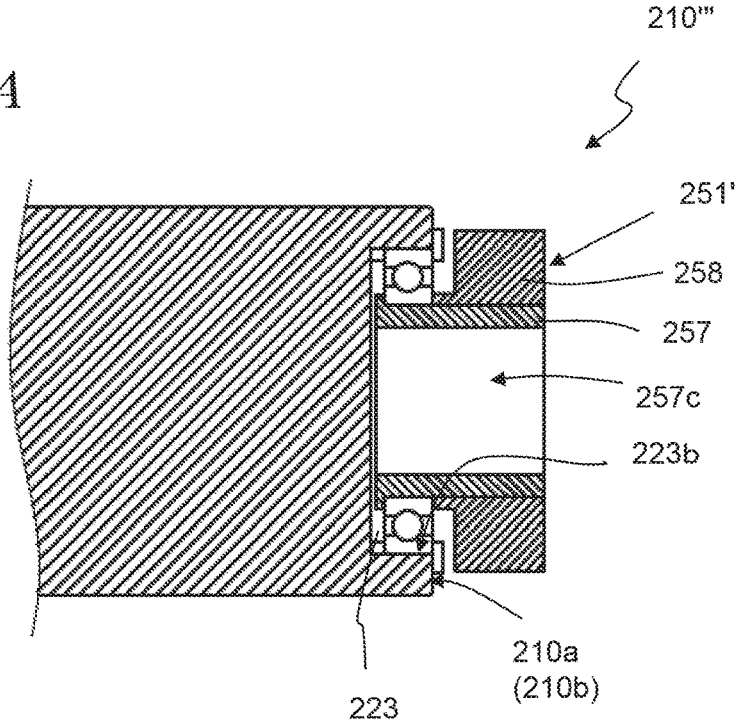
FIGS. 11A and 11B are perspective views showing another embodiment of a cutter roll/anvil roll.
Figure 11B:
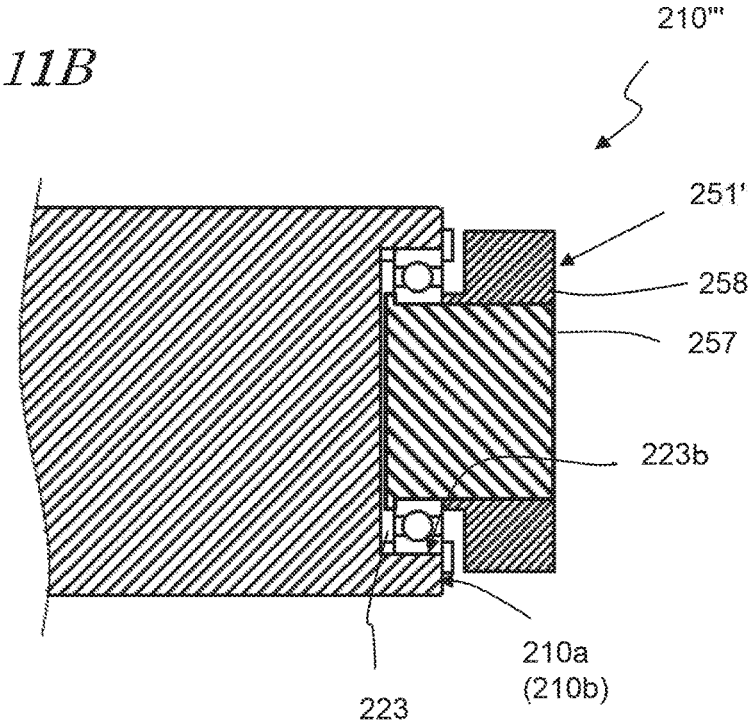

Note that in the present embodiment, the bearings are in contact with the outer wall of the ring-shaped depressions of the cutter roll and the anvil roll. Therefore, no shaft is required in view of the support of the cutter roll and the anvil roll by the support frame. When the cutter roll and the anvil roll are provided with no shaft, cylindrical depressions, instead of ring-shaped depressions, may be provided at the end surfaces 110*a* and 110*b* and the end surfaces 210*a* and 210*b*. For example, when the anvil roll is not to be driven by a shaft, an anvil roll 201''' having no shaft as shown in FIG. 11 may be used. The anvil roll 201''' includes no shaft but includes cylindrical depressions 223 provided at the end surface 210*a* and the end surface 210*b*. The bearing structure 251' is in contact with the outer wall 213*b* of a cylindrical depression 223, and the bearing structure 251' is in contact with the outer wall 213*b* of the cylindrical depression 223. The bearing structure 251' is supported on the support frame 301, thereby rotatably supporting the anvil roll 201''' on the support frame 301. It is to be noted that each cylindrical depression 223 does not have an inner wall. However, the outer wall 213*b* of the cylindrical depression 223 is located at the position that corresponds to the outer wall of the ring-shape depression 213. Therefore, the side wall of the cylindrical depression 223 is named as the outer wall 213*b*. The outer wall 213*b* may be referred to as a "side wall".

If one of the two rolls of the rotary cutter do not include a shaft, it is preferred that the other roll includes a shaft. The shaft 112 of the other roll is provided with gears, pulleys, etc., so that the rotational driving force from a drive source such as a motor is transmitted to the shaft via gears and belts. Thus, the roll having the shaft rotates. The roll having no shaft can rotate in the opposite direction to that of the roll having the shaft by virtue of a friction force received from the contact surface of the guide ring 114.

(Other Embodiments)

Various modifications can be made to a cutter roll and an anvil roll (i.e., two rolls for a rotary cutter) of the present disclosure and a rotary cutter having the same. The first to fourth embodiments set forth above may be used in combination. For example, the fourth embodiment may be combined with the second and third embodiments.

The table below shows possible combinations of whether or not the roll for a rotary cutter has a shaft and the position at which the bearing structure 251' supports the roll for a cutter roll.

TABLE 1

| Shaft | Bearing contact position |
|---|---|
| Present | Side surface of shaft (First to third embodiments) or Outside surface of depression (Fourth embodiment) |
| Absent | Outside surface of depression (Fourth embodiment) |

Figure 12:
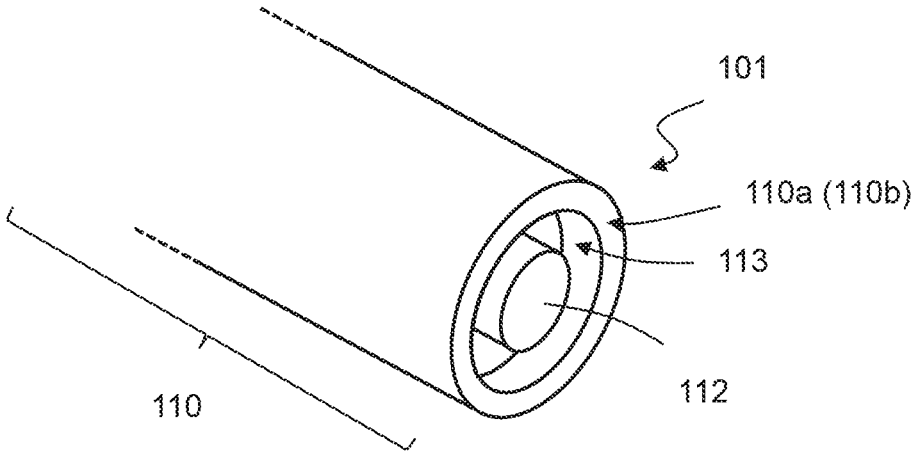
FIG. 12 is a perspective view showing another embodiment of a shape of a cutter roll/anvil roll.

While a shaft is connected to each end surface of a roll for a rotary cutter, protruding from the end surface, in the embodiments described above, the shaft may be located flush with the end surface 110*a*, 110*b* (210*a*, 210*b*), as shown in FIG. 12, or may be located closer to the center in the axial direction of the barrel portion than the end surface. That is, the shaft may be only present within the ring-shaped depression 113.

Also, as is recited hereinabove, a roll for a rotary cautter may not include a shaft. In this case, as shown in FIG. 11A the bearing structure 251' has a center hole 257*c* at the bearing holder 257, or the bearing structure 251' may includes the bearing holder 257 which has no center hole.

Figure 13:
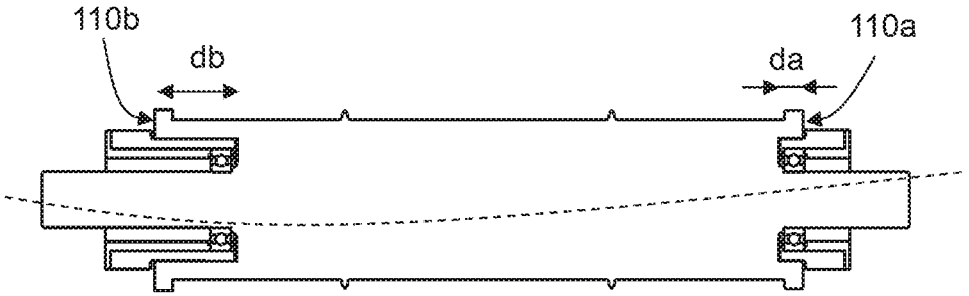
FIG. 13 is a schematic cross-sectional view showing another embodiment of a cutter roll.

A pair of bearings of the cutter roll and those of the anvil roll are arranged in symmetry with respect to the center in the axial direction of the circumferential surface in the first to fourth embodiments. However, the bearings may be in an asymmetric arrangement with respect to the center in the axial direction of the circumferential surface. Specifically, the depth da of the ring-shaped depression 113' provided at the end surface 110*a* of the cutter roll may be different from the depth db of the ring-shaped depression 113" provided at the end surface 110*b* of the cutter roll, as shown in FIG. 13. When db>da, for example, the position at which the deflection of the cutter roll toward the anvil roll is at maximum is shifted off the center in the axial direction a toward the end surface 110*b*. Such a configuration is preferable, for example, in cases where the maximum value of the line density of the cutting blade 116 in the circumferential direction of the circumferential surface 110*c* is shifted off the center in the axial direction a toward the end surface 110*b*.

As described above in the third embodiment, if a ring-shaped or cylindrical depression is provided at the end surface of the barrel portion of at least one of the cutter roll and the anvil roll of the rotary cutter of the present disclosure and a portion of the bearing portion of the bearing structure is arranged inside the depression, the position of the bearing can be adjusted in the axial direction depending on the depth of the depression. This allows for arbitrary adjustments of the magnitude and the shape of deflection of the cutter roll and those of the anvil roll. The depression may be provided only for the cutter roll, only for the anvil roll, or for both of the cutter roll and the anvil roll of the rotary cutter.

While the first to fourth embodiments employ a structure in which the pressure mechanism applies a pressure on the support portion of the anvil roll, the pressure mechanism may apply a pressure on the support portion of the cutter roll.

As described above in the first to fourth embodiments and in other embodiments, with a cutter roll, an anvil roll and a rotary cutter of the present disclosure, by adjusting the depth of the ring-shaped depression provided at the end surface of the barrel portion of at least one of the cutter roll and the anvil roll, it is possible to change the position of the bearing in the axial direction and to thereby independently control the deformation of the cutter roll and that of the anvil roll. Specifically, irrespective of the diameter ratio between the cutter roll and the anvil roll, it is possible to independently control the direction of deflection and the curvature of deflection of the cutter roll and the anvil roll. Therefore, depending on the various patterns of cutting blades arranged on the circumferential surface of the cutter roll, it is possible to bend the cutter roll and the anvil roll in a preferable direction and control the deflection thereof. As a result, it is possible to operate the rotary cutter with an appropriate load and load distribution, and it is possible to reduce the possibility of the cutting blade chipping and to elongate the life of the cutter roll 101 and the continuous operation time of the rotary cutter. It is also possible to reduce the frequency of maintenance for the rotary cutter or reduce the interruption of manufacture due to maintenance, realizing a high productivity.

A cutter roll, an anvil roll and a rotary cutter of the present disclosure are applicable to cutting a material to be cut, such as a web of cloth, paper, non-woven fabric, resin, metal foil, etc., in various fields, into a desired shape.

While the present invention has been described with respect to exemplary embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A rotary cutter comprising a cutter roll and an anvil roll, the cutter roll comprising:

a barrel portion having a circumferential surface and a pair of end surfaces located respectively at opposite ends of the circumferential surface;

a pair of shafts connected to the barrel portion and having an axis that coincides with an axis of the circumferential surface;

a cutting blade located on the circumferential surface, the cutting blade having a cutting shape; and a pair of guide rings located respectively at opposite ends of the circumferential surface in a longitudinal direction, the anvil roll comprising:

a barrel portion having a circumferential surface that receives the cutting blade and a pair of end surfaces located respectively at opposite ends of the circumferential surface; and a pair of shafts connected to the barrel portion and having an axis that coincides with an axis of the circumferential surface, at least one of the cutter roll and the anvil roll comprising:

a pair of first depressions located respectively at the pair of end surfaces of the barrel portion and each having a ring shape extending around the shaft, the pair of first depressions each having a depth direction that is parallel to the axis of the shaft;

a pair of first bearings located respectively in the pair of first depressions and each being in contact with the shaft of the first depressions, the pair of first bearings not contacting an outer wall that forms the circumferential surface; and a pair of first bearing boxes located on an outside of the pair of first depressions and having support portions to be in contact with a support frame or a pressure mechanism, the pair of first bearing boxes supporting the respective first bearings.

2. The rotary cutter according to claim 1, wherein each of the pair of first bearings is arranged at a position that at least partially overlaps with the corresponding guide ring in an axial direction of the circumferential surface.

3. The rotary cutter according to claim 1, wherein each of the pair of first bearings is arranged more on an inner side of the corresponding end of the circumferential surface than the corresponding guide ring in the axial direction of the circumferential surface.

4. The rotary cutter according to claim 1, wherein the pair of first depressions, the pair of first bearings and the pair of first bearing boxes are located on the cutter roll.

5. The rotary cutter according to claim 4, the anvil roll comprising:

a pair of second depressions located respectively at a pair of end surfaces of the barrel portion and each having a ring shape extending around the shaft, the pair of second depressions each having a depth direction that is parallel to an axis of the barrel portion;

a pair of second bearings respectively located in the pair of second depressions and each being in contact with the shaft or outer walls of the pair of second depressions; and a pair of second bearing boxes located on an outside of the second depressions and having support portions to be in contact with a support frame or a pressure mechanism, the pair of second bearing boxes supporting the respective bearings.

6. The rotary cutter according to claim 5, wherein an interval between the pair of first bearings is different from an interval between the pair of second bearings.

7. The rotary cutter according to claim 6, further comprising the support frame, wherein the support frame is in contact with the support portions of the pair of first bearing boxes and the support portions of the pair of second bearing boxes, supporting the cutter roll and the anvil roll.

8. The rotary cutter according to claim 7, further comprising the pressure mechanism, wherein the pressure mechanism applies a load on the support portions of the pair of first bearing boxes of one of the cutter roll and the anvil roll in such a manner that an axis of the one of the cutter roll and the anvil roll comes closer to an axis of the other one of the cutter roll and the anvil roll.

9. The rotary cutter according to claim 1, wherein the pair of first depressions, the pair of first bearings and the pair of first bearing boxes are located on the anvil roll.

10. The rotary cutter according to claim 1, wherein an interval between the pair of first bearings is equal to or less than an interval between the pair of guide rings in an axial direction of the circumferential surface.

11. The rotary cutter according to claim 1, wherein the pair of first bearings are in an asymmetric arrangement with respect to a center in an axial direction of the circumferential surface.

12. The rotary cutter according to claim 1, further comprising the support frame, wherein the support frame is in contact with the support portions of the pair of first bearing boxes, supporting at least one of the cutter roll and the anvil roll.

13. The rotary cutter according to claim 1, wherein the pair of first bearing boxes are in contact with the only respective first bearings, the support frame, and the pressure mechanism.

14. The rotary cutter according to claim 13, wherein the pair of first bearing are in contact with only the pair of first bearing boxes, the pair of shafts, the outer walls of the first depressions.

15. A rotary cutter comprising a cutter roll and an anvil roll, the cutter roll comprising:

a barrel portion having a circumferential surface and a pair of end surfaces located respectively at opposite ends of the circumferential surface;

a cutting blade located on the circumferential surface, the cutting blade having a cutting shape; and a pair of guide rings located respectively at opposite ends of the circumferential surface in a longitudinal direction, the anvil roll comprising:

a barrel portion having a circumferential surface that receives the cutting blade and a pair of end surfaces located respectively at opposite ends of the circumferential surface, only one of the cutter roll and the anvil roll comprising:

a pair of shafts connected to the barrel portion and having an axis that coincides with an axis of the circumferential surface, at least one of the cutter roll and the anvil roll comprising:

a pair of first depressions located respectively at the pair of end surfaces of the barrel portion and having a ring shape or a cylindrical shape, the pair of first depressions each having a depth direction that is parallel to an axis of the barrel portion, or a pair of first depressions located respectively at the pair of end surfaces of the barrel portion and each having a ring shape extending around the shaft, the pair of first depressions each having a depth direction that is parallel to the axis of the shaft;

a pair of first bearings located respectively in the pair of first depressions and each being in contact with the shaft of the first depressions, the pair of first bearings not contacting an outer wall that forms the circumferential surface; and a pair of first bearing boxes located on an outside of the pair of first depressions and having support portions to be in contact with a support frame or a pressure mechanism, the pair of first bearing boxes supporting the respective first bearings.

* * * * *